US012808162B2

(12) United States Patent
Fukuda et al.

(10) Patent No.: US 12,808,162 B2
(45) Date of Patent: Nov. 24, 2026

(54) WORKING VEHICLE AND ATTACHMENT USAGE SYSTEM

(71) Applicant: KUBOTA CORPORATION, Osaka (JP)

(72) Inventors: Yuji Fukuda, Sakai (JP); Tomoyuki Noguchi, Sakai (JP); Daichi Kino, Sakai (JP); Ryuki Matsumoto, Sakai (JP); Kevin James Kerr, Grapevine, TX (US)

(73) Assignee: KUBOTA CORPORATION, Osaka (JP)

( * ) Notice: Subject to any disclaimer, the term of this patent is extended or adjusted under 35 U.S.C. 154(b) by 114 days.

(21) Appl. No.: 18/609,000

(22) Filed: Mar. 19, 2024

(65) Prior Publication Data

US 2025/0297463 A1 Sep. 25, 2025

(51) Int. Cl.
*E02F 9/26* (2006.01)

(52) U.S. Cl.
CPC ..... *E02F 9/267* (2013.01); *E02F 9/264* (2013.01)

(58) Field of Classification Search
CPC ... E02F 9/26; E02F 9/264; E02F 9/267; E02F 9/268
See application file for complete search history.

(56) References Cited

U.S. PATENT DOCUMENTS

| | | | | |
|---|---|---|---|---|
| 2004/0186687 | A1* | 9/2004 | Ogura | E02F 9/268 702/185 |
| 2005/0283295 | A1* | 12/2005 | Normann | E02F 9/26 701/50 |
| 2018/0187398 | A1* | 7/2018 | Forcash | E02F 9/264 |
| 2020/0109537 | A1* | 4/2020 | Yamamitsu | E02F 9/163 |
| 2021/0123218 | A1* | 4/2021 | Matzelle | E02F 3/96 |
| 2022/0412040 | A1 | 12/2022 | Zitterbart et al. | |
| 2023/0358021 | A1* | 11/2023 | Garramone | E02F 3/431 |

* cited by examiner

*Primary Examiner* — Erin D Bishop
*Assistant Examiner* — Alex B Griffin
(74) *Attorney, Agent, or Firm* — Keating & Bennett, LLP

(57) ABSTRACT

A controller for a working vehicle is configured or programmed to, when an attachment is attached to a hitch, select, as identification-information-at-attaching, one of piece(s) of identification information that is included in one of wireless signal(s) transmitted from a transmitter in or on the attachment and received by a receiver according to a predetermined condition, then, when the working vehicle takes action, select, as identification-information-at-action, one of the piece(s) of identification information that is included in one of the wireless signal(s) received by the receiver according to a predetermined condition, and, if the identification-information-at-attaching and the identification-information-at-action differ from each other, cause an output to output an alert.

22 Claims, 21 Drawing Sheets

Fig.3

| |
|---|
| ADV information<br>(attachment ID, vibration information, time information, RSSI, etc.) |
| ADV information<br>(attachment ID, vibration information, time information, RSSI, etc.) |
| ADV information<br>(attachment ID, vibration information, time information, RSSI, etc.) |
| ⋮ |

Fig.4

| Attachment ID | Display data |
| --- | --- |
| ATT0001 | Name<br>Specifications<br>Icon etc. |
| ATT0002 | Name<br>Specifications<br>Icon etc. |
| ATT0003 | Name<br>Specifications<br>Icon etc. |
| ⋮ | ⋮ |

Fig.5

| Attachment ID | Control data<br>Amount of supply of hydraulic fluid |
|---|---|
| ATT0001 | None |
| ATT0002 | Small |
| ATT0003 | Large |
| ⋮ | ⋮ |

L1

| Name | Attachment ID | Specifications |
|---|---|---|
| Bucket | ATT0001 | Excavation, Large, Total length, Total width,etc. |
| Spreader | ATT0002 | Spreading, Total length, Total width, etc. |
| Skid cutter | ATT0003 | Mowing, Small, Total length, Total width, etc. |
| Pallet fork | ATT00xy | Cargo handling, Total length, Total width, etc. |
| Bucket | ATT00xx | Excavation, Small, Total length, Total width,etc. |
| | ⋮ | ⋮ |

Fig.13

WORKING VEHICLE AND ATTACHMENT USAGE SYSTEM

BACKGROUND OF THE INVENTION

1. Field of the Invention

The present invention relates to techniques to use attachments on working vehicles.

2. Description of the Related Art

For example, the specification of U.S. Patent Application Publication No. 2022/412040 discloses a system to automatically determine the positions of attachments in the vicinity of a working vehicle. The system is such that a first communication unit (tool module) including a first acceleration sensor is provided on an attachment such as a bucket, a quick changer configured to quickly and simply attach and detach the attachment thereto and therefrom is provided at the distal end of the boom of the working vehicle (excavator), a second communication unit (receiving module) including a second acceleration sensor is provided at the quick changer, and the working vehicle is provided with an identification module and a controller.

The first communication unit transmits, to the second communication unit via a near field communication such as RFID or Bluetooth (registered trademark) Low Energy, a first acceleration signal relating to the instantaneous acceleration of the attachment detected by the first acceleration sensor and an identifying signal of the attachment. The second communication unit transmits, to the identification module, the first acceleration signal and the identifying signal received from the first communication unit and the second acceleration signal relating to the instantaneous acceleration of the quick changer detected by the second acceleration sensor. The identification module identifies the attachment attached to the quick changer based on the comparison (e.g., difference) between the first acceleration signal and the second acceleration signal received from the second communication unit, and transmits the identification information of the attachment to the controller. The controller performs an appropriate operation (work operation) of the working vehicle based on the received identifying signal.

However, there may be cases in which, for example, when the quick changer and the attachment vibrate only a little or another attachment in the vicinity of the working vehicle vibrates similarly to the quick changer due to some disturbance, the identification module wrongly identifies the attachment attached to the quick changer based on a first acceleration signal and an identifying signal from the first communication unit on the other attachment, resulting in inappropriate use of the attachment on the working vehicle. Example embodiments of the present invention make it possible to address errors concerning identification information of the attachment attached to the working vehicle.

SUMMARY OF THE INVENTION

A working vehicle according to an example embodiment of the present invention includes a hitch to attach and detach an attachment thereto and therefrom, a receiver to receive one or more wireless signals which are transmitted periodically from one or more transmitters in or on one or more of the attachments, which include respective one or more pieces of identification information of the one or more attachments, and which are compliant with a near field communication standard, and a controller, wherein the controller is configured or programmed to, when the attachment is attached to the hitch, select, as identification-information-at-attaching, one of the one or more pieces of identification information that is included in one of the one or more wireless signals received by the receiver according to a predetermined condition, then when the working vehicle takes action, select, as identification-information-at-action, one of the one or more pieces of identification information that is included in one of the one or more wireless signals received by the receiver according to a predetermined condition, and if the identification-information-at-attaching and the identification-information-at-action differ from each other, cause an output to output an alert.

An attachment usage system according to an example embodiment of the present invention is an attachment usage system to use one or more attachments on the working vehicle, and includes the hitch, one or more of the transmitters, the receiver, the controller, and the output. The controller and the output may be provided somewhere other than the working vehicle.

The working vehicle may further include a user interface which is the output. The controller may be configured or programmed to cause the user interface to output prompt information requesting to check the attachment attached to the hitch, the prompt information being the alert.

The controller may be configured or programmed to perform a predetermined process based on the identification-information-at-attaching, and when attachment information is inputted via the user interface after the alert is outputted, perform the predetermined process based on the attachment information.

In a working vehicle and an attachment usage system according to an example embodiment of the present invention, the controller is configured or programmed to, if the identification-information-at-attaching and the identification-information-at-action differ from each other, perform a predetermined process based on the identification-information-at-action.

The controller may be configured or programmed to perform the predetermined process based on the identification-information-at-attaching and then select the identification-information-at-action.

The controller may be configured or programmed to select one piece of identification-information-at-action during a period from when the controller selects the identification-information-at-attaching to when the attachment is allowed to be detached from the hitch.

The working vehicle may further include a vehicle body, and a traveling device and a working device which are on the vehicle body. The hitch may be connected to the working device. The controller may be configured or programmed to, when at least one of the traveling device or the working device takes action while the identification-information-at-attaching is selected but no identification-information-at-action is selected, select identification-information-at-action that is included in one of the one or more wireless signals received by the receiver according to the predetermined condition.

The working vehicle may further include a travel operator to be operated to actuate the traveling device, and a work operator to be operated to actuate the working device. The controller may be configured or programmed to, when at least one of the travel operator or the work operator is operated while the identification-information-at-attaching is selected but no identification-information-at-action is selected, select identification-information-at-action that is included in one of the one or more wireless signals received by the receiver according to the predetermined condition.

The controller may be configured or programmed to cause a memory to store the one or more pieces of identification information included in the one or more wireless signals after the receiver receives the one or more wireless signals, and while the identification-information-at-attaching is selected but no identification-information-at-action is selected, select, according to the predetermined condition, identification-information-at-action that is included in one of one or more of the one or more wireless signals that are received by the receiver during a period from a first point in time to a second point in time, the first point in time being a point in a first time period before when at least one of the travel operator or the work operator is operated, the second point in time being a point in a second time period after when the at least one of the travel operator or the work operator stops being operated.

The working vehicle may further include a power output port to allow power to be outputted to the attachment attached to the hitch, and a power operator to be operated to allow power to be outputted through the power output port. The controller may be configured or programmed to, when the power operator is operated and power is outputted through the power output port while the identification-information-at-attaching is selected but no identification-information-at-action is selected, select, according to the predetermined condition, identification-information-at-action that is included in one of the one or more wireless signals received by the receiver.

The controller may be configured or programmed to, when the attachment is attached to the hitch, select identification-information-at-attaching that is included in one of the one or more wireless signals received by the receiver according to a first condition, and when the working vehicle takes action while the identification-information-at-attaching is selected but no identification-information-at-action is selected, select identification-information-at-action that is included in one of the one or more wireless signals received by the receiver according to a second condition differing from the first condition.

The second condition may include a condition in which the controller selects, as the identification-information-at-action, a piece of identification information included in a specific wireless signal which is one of one or more of the one or more wireless signals with a received signal strength higher than a predetermined value and that includes vibration information indicating that the attachment is vibrating.

The second condition may include a condition in which the controller selects, as the identification-information-at-action, a piece of identification information included in a specific wireless signal which is one of two or more of the one or more wireless signals that include a same piece of identification information and that have been received by the receiver a predetermined number of times or more within a predetermined period of time.

The working vehicle may further include an attaching switch to be operated to attach the attachment to the hitch. The controller may be configured or programmed to select, according to the predetermined condition, identification-information-at-attaching that is included in one of the one or more wireless signals received by the receiver when the attaching switch is operated or when the attaching switch has been operated continuously for a predetermined period of time or more.

The controller may be configured or programmed to select, according to the predetermined condition, identification-information-at-attaching that is included in one of the one or more wireless signals received by the receiver in at least one of (i) a third time period which ends when the attaching switch is operated or when the attaching switch has been operated continuously for the predetermined period of time or more or (ii) a fourth time period which starts when the attaching switch is operated or when the attaching switch has been operated continuously for the predetermined period of time or more.

The controller may be configured or programmed to, if the controller fails to select any identification-information-at-action according to the predetermined condition, cause the output to output an alert.

The output may include a display. Each of the one or more transmitters may be a beacon transmitter to transmit an advertisement signal including a piece of identification information of the attachment in or on which the transmitter is provided. The receiver may be a beacon scanner to receive the advertisement signal.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

FIG. 3 is a diagram showing ADV information stored in an internal memory.

FIG. 4 is a diagram showing an example of the relationship between attachment IDs and their corresponding pieces of display data.

FIG. 5 is a diagram showing an example of the relationship between attachment IDs and their corresponding pieces of control data.

FIG. 13 illustrates a screen showing an example of an attachment list.

DETAILED DESCRIPTION OF THE EXAMPLE EMBODIMENTS

Figure 1:
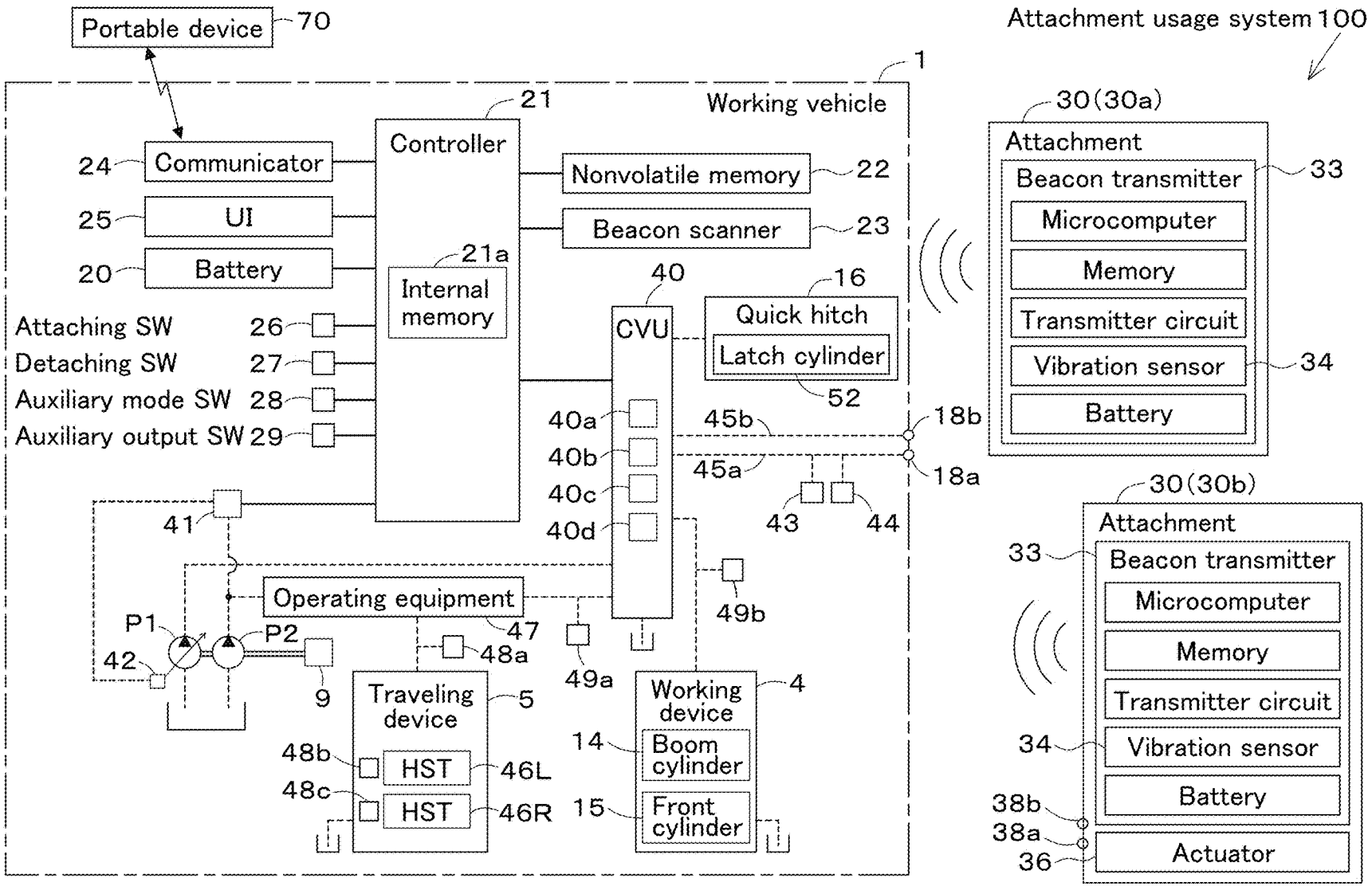
FIG. 1 is a block diagram of an attachment usage system and a working vehicle.

The example embodiments will now be described with reference to the accompanying drawings, wherein like reference numerals designate corresponding or identical elements throughout the various drawings. The drawings are to be viewed in an orientation in which the reference numerals are viewed correctly.

The following description discusses example embodiments of the present invention with reference to the drawings as needed.

Figure 18:
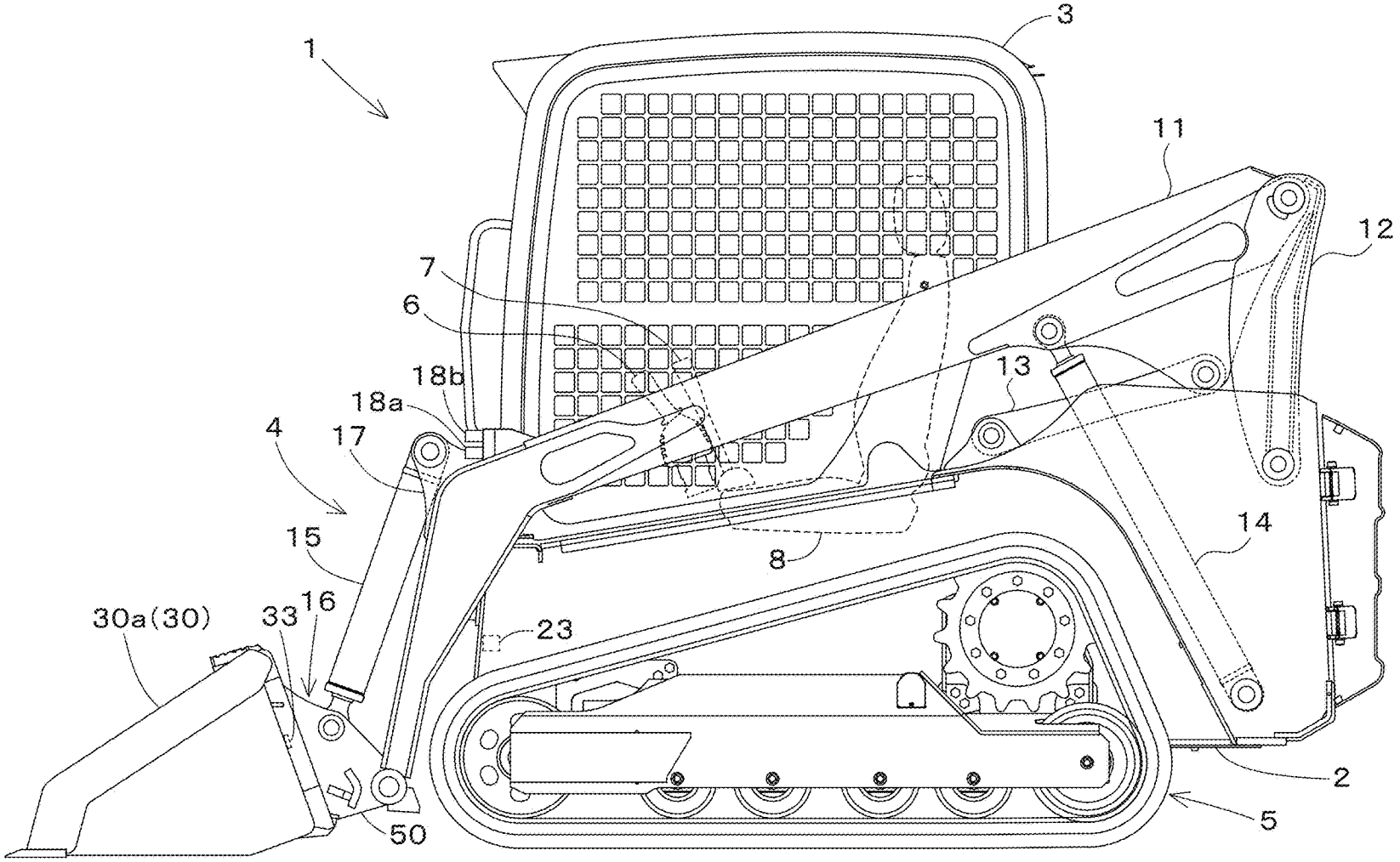
FIG. 18 is a side view of a working vehicle.

FIG. 18 is a side view of a working vehicle 1 according to the present example embodiment. In the present example embodiment, a compact track loader is discussed as an example of the working vehicle 1. Note, however, that the working vehicle according to an example embodiment of the present invention is not limited to a compact track loader, and may be, for example, some other construction machine or agricultural machine such as a skid-steer loader, a backhoe, or a tractor.

The working vehicle 1 includes a vehicle body 2, a cabin 3, a working device 4, and traveling device(s) 5. The cabin 3 is provided on the vehicle body 2. The cabin 3 includes a seat 8, operators (manual operators) to be operated by a user seated on the seat 8, and/or the like. The operators include a travel operator 6 to be operated to actuate the traveling devices 5 and a work operator 7 to be operated to actuate the working device 4.

The traveling devices 5 are provided on the left and right sides of the vehicle body 2 and support the vehicle body 2 such that the vehicle body 2 is allowed to travel. The traveling devices 5 are crawler traveling devices. The user operates the travel operator 6 to cause both the left and right traveling devices (the traveling device on the left side and the traveling device on the right side) 5 to rotate in a forward direction, both the left and right traveling devices 5 to rotate in a reverse direction, only one of the left and right traveling devices 5 to rotate in the forward direction, or one of the left and right traveling devices 5 to rotate in the forward direction and the other to rotate in the reverse direction to cause the vehicle body 2 (working vehicle 1) to travel forward, rearward, or turn left or right. The travel operator 6 can be operated in operation states corresponding to forward travel, rearward travel, left turn, right turn, and stop of the traveling devices 5.

The working device 4 is attached to the vehicle body 2. The working device 4 includes a boom cylinder(s) 14, and front cylinder(s) 15. The booms 11, the lift links 12, the control links 13, the boom cylinders 14, and the front cylinders 15 are provided at the left and right of the cabin 3. The left and right booms 11 are connected to each other by a connector 17 at an intermediate portion of their front portion. The left boom 11 has, at the front portion thereof, a hydraulic fluid outlet port (power output port) 18*a* and a hydraulic fluid inlet port 18*b*.

The lift links 12 and the control links 13 support proximal portions (rear portions) of the booms 11 via shafts such that the booms 11 are swingable up and down. The boom cylinders 14 each have one end thereof pivotally connected to a corresponding one of the booms 11 via a shaft and the other end thereof pivotally connected to a lower rear portion of the vehicle body 2 via a shaft. Upon operation of the work operator 7 along a first direction by the user of the working vehicle 1, the boom cylinders 14 extend or retract and the booms 11 ascend or descend (swing upward or downward).

The booms 11 are provided with the quick hitch 16 at the distal ends thereof. The quick hitch 16 is a linkage configured to easily attach and detach any of various attachments (hydraulic driven working tools) 30 such as the bucket 30*a*. The user of the working vehicle 1 can easily change attachments 30 using the quick hitch 16. The quick hitch 16 is therefore also called "quick changer". In the example shown in FIG. 18, the bucket 30*a* which is an example of the attachment 30 is attached to a front portion of the quick hitch 16.

The quick hitch 16 has, connected to a rear portion thereof, the distal ends of the booms 11 and ends of the front cylinders 15 via respective shafts such that the booms 11 and the front cylinders 15 are pivotable. The opposite ends of the front cylinders 15 are pivotally connected to the connector 17 via shafts. Upon operation of the work operator 7 along a second direction by the user, the front cylinders 15 extend or retract and the quick hitch 16 swings upward or downward. With this, the bucket 30*a* attached to the quick hitch 16, swinging upward or downward, performs shoveling or dumping.

Figure 19:
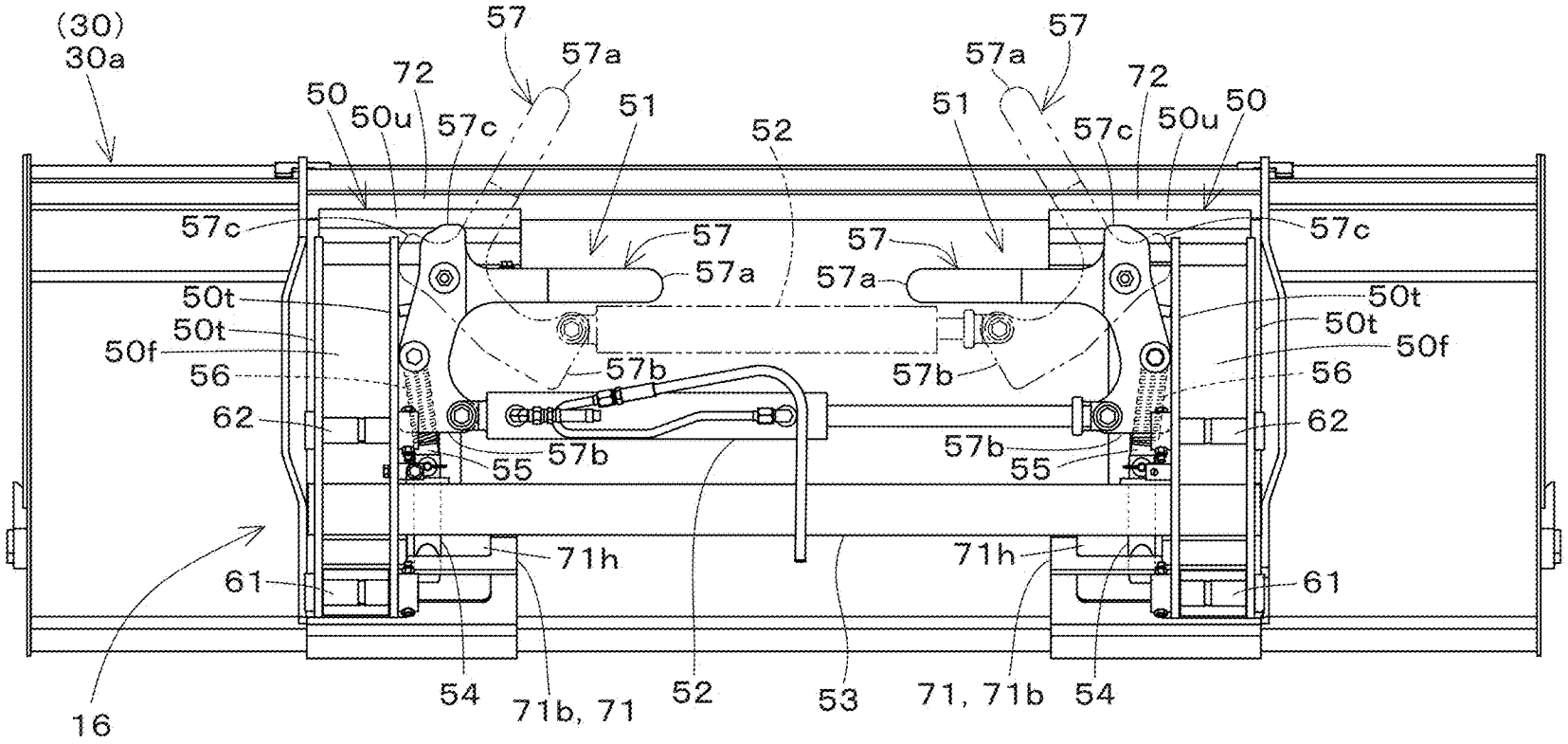
FIG. 19 is an elevational view of a quick hitch.
Figure 20A:
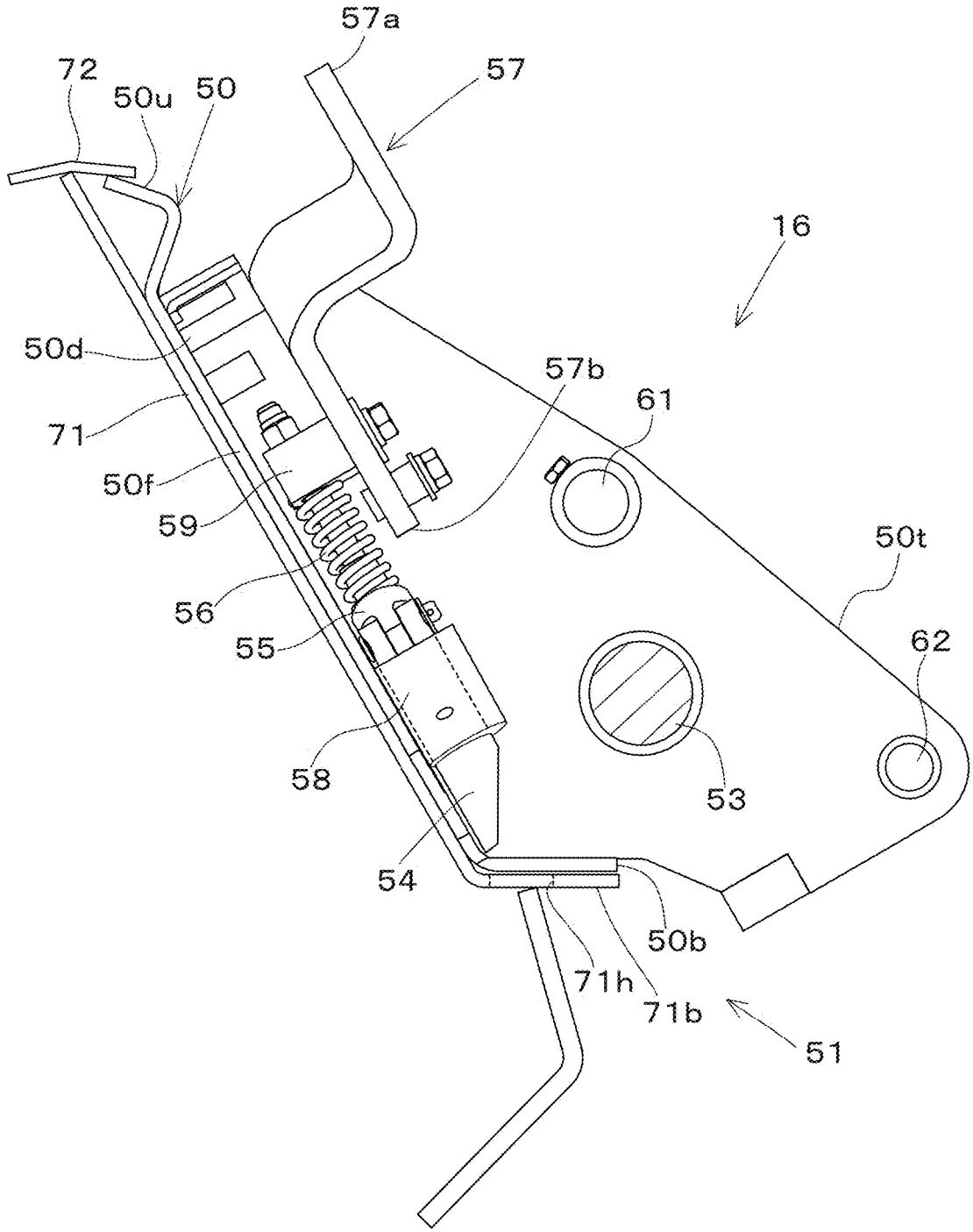
FIG. 20A is a side view of an attachment unlatched by a quick hitch.
Figure 20B:
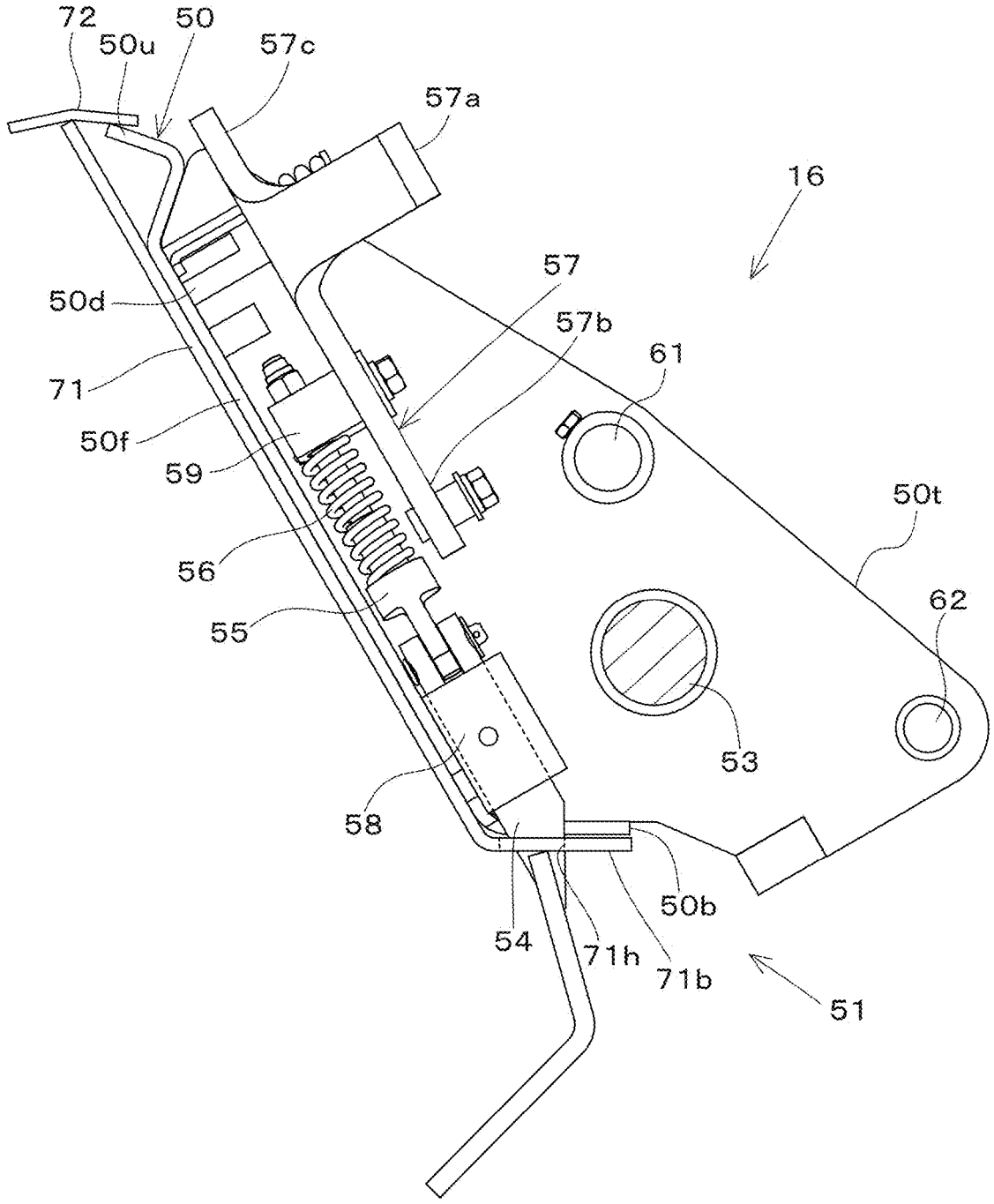
FIG. 20B is a side view of an attachment latched by a quick hitch.

FIG. 19 is an elevational view of the quick hitch 16. Specifically, FIG. 19 illustrates the quick hitch 16 in FIG. 18 as viewed from the vehicle body 2 of the working vehicle 1. FIG. 20A is a side view of an attachment 30 unlatched by a quick hitch 16. FIG. 20B is a side view of the attachment 30 latched by a quick hitch 16.

The quick hitch 16 includes a pair of left and right brackets 50, a pair of left and right latching mechanisms 51, a latch cylinder 52, and the like. The brackets 50 hold the attachment 30. The latching mechanisms 51 are selectively operable in a latching state in which the attachment 30 is secured to the brackets 50 (quick hitch 16) or an unlatching state in which the attachment 30 is allowed to be detached from the brackets 50. The latch cylinder 52 is a latch actuator to place the latching mechanisms 51 selectively in the latching state or the unlatching state.

As illustrated in FIG. 20A, each of the brackets 50 includes a front plate 50*f* and a pair of connector plates 50*t* projecting rearward from the front plate 50*f*. The connector plates 50*t* have pivotally connected thereto the distal ends of the left and right booms 11 (FIG. 18) via shafts 61, and have pivotally connected thereto ends of the left and right front cylinders 15 (FIG. 18) via shafts 62. The connector plates 50*t* are connected to a beam 53, so that the pair of brackets 50 are combined.

The front plate 50*f* of each of the brackets 50 includes an upper portion 50*u* bent in the form of the letter V as illustrated in FIG. 20A. The front plate 50*f* includes a lower portion 50*b* bent such that the lower portion 50*b* projects diagonally rearward. A top plate 72 bent downward is provided above a base plate 71 of the attachment 30. The base plate 71 includes a lower portion 71*b* bent such that the lower portion 71*b* projects diagonally rearward. The lower portion 71*b* of the base plate 71 has a through-hole 71*h*.

The upper portions 50*u* of the front plates 50*f* of the brackets 50 are inserted into the gap between the base plate 71 and the top plate 72 of the attachment 30 and engage with the back surface of the top plate 72, the front surfaces of the front plates 50*f* engage with the base plate 71, and the lower portions 50*b* of the front plates 50*f* engage with the lower portion 71*b* of the base plate 71. With this, the attachment 30 is held by the brackets 50.

The latching mechanisms 51 are located inward of the connector plates 50*t* of the brackets 50 in FIG. 19. Each of the latching mechanisms 51 includes, as illustrated in FIG. 20A, a latch pin 54, a link 55, a coil spring 56, a latch lever 57, and the like. The latch pin 54 is held by a housing 58 fixed to a corresponding bracket 50 such that the latch pin 54 is movable up and down. The latch pin 54 includes a lower portion projecting downward from the housing 58, and the lower portion has an inclined surface sloping diagonally forward and downward. The latch pin 54 includes an upper portion rotatably connected to a lower end portion of the link 55 via pin(s). The link 55 is inserted in the coil spring 56. The link 55 includes an upper end portion projecting from the coil spring 56, and the upper end portion is held by a holder 59.

Each latch lever 57 is substantially in the form of the letter L as illustrated in FIG. 19. The latch lever 57 includes a bent intermediate portion which is rotatably connected to a mount 50*d* on a corresponding bracket 50 via pin(s) as illustrated in FIG. 20A. The latch lever 57 includes a first projecting portion 57*a* which projects inward from corresponding connector plates 50*t* as illustrated in FIG. 19. The latch lever 57 includes a second projecting portion 57*b* projecting downward. The second projecting portion 57*b* has, connected to a back surface of a central portion thereof, the holder 59 via pin(s) as illustrated in FIG. 20A. The latch lever 57 includes a third projecting portion 57*c* which projects upward as illustrated in FIG. 19.

The latch cylinder 52 is a hydraulic cylinder which is positioned laterally and located above the beam 53. The latch cylinder 52 has a first end (distal end of the rod) pivotally connected to the distal end portion of the second projecting portion 57*b* of one of the latch levers 57 (right latch lever 57 in FIG. 19) via pin(s). The latch cylinder 52 has a second end (bottom of the cylinder case) pivotally connected to the distal end portion of the second projecting portion 57*b* of the other of the latch levers 57 (the left latch lever 57 in FIG. 19) via pin(s).

The retraction of the latch cylinder 52, as indicated by dot-dot-dash lines in FIG. 19, causes the second projecting portions 57*b* of the left and right latch levers 57 to approach each other, causing the latch levers 57 to pivot upward. Then, as illustrated in FIG. 20A, the links 55 and the latch pins 54 move upward and the latch pins 54 detach from the through-holes 71*h* in the base plate 71 of the attachment 30.

With this, the latching mechanisms 51 are placed in their unlatching state (also referred to as "unlock state") in which the latching mechanisms 51 do not hold the attachment 30, allowing the attachment 30 to be detached from the quick hitch 16. The third projecting portions 57*c* of the latch levers 57 contact corresponding connector plates 50*t* of the brackets 50, so that the degree of retraction of the latch cylinder 52, the angle of upward rotation of the latch levers 57, and the degree of upward movement of the latch pins 54 are restricted.

Upon the extension of the latch cylinder 52 as indicated by solid lines in FIG. 19 from the state as illustrated in FIG. 20A, the second projecting portions 57*b* of the left and right latch levers 57 are pushed to cause the latch levers 57 to pivot downward. Upon such pivoting, the holders 59 cause the links 55 and the latch pins 54 to move downward and compress the coil springs 56. Then, as illustrated in FIG. 20B, the latch pins 54 are inserted in the through-holes 71*h* in the base plate 71 of the attachment 30, so that the inclined surfaces of the latch pins 54 contact the side walls of the through-holes 71*h*.

With this, the latching mechanisms 51 are placed in their latching state (also referred to as "lock state") in which the latching mechanisms 51 hold the attachment 30, and the attachment 30 is attached to the quick hitch 16. The second projecting portions 57*b* of the latch levers 57 contact corresponding connector plates 50*t* of the brackets 50, so that the degree of extension of the latch cylinder 52, the angle of downward rotation of the latch levers 57, and the degree of downward movement of the latch pins 54 are restricted. It is noted here that the spring back force of the coil springs 56 holds the latch levers 57 in position. Since the first projecting portions 57*a* of the latch levers 57 are positioned horizontally, the user seated on the seat 8 of the working vehicle 1 confirms that the attachment 30 is attached to the quick hitch 16 (working vehicle 1) by looking at the horizontally positioned first projecting portions 57*a*.

Starting from the state as illustrated in FIG. 18 in which the bucket 30*a* is attached to the quick hitch 16, the bucket 30*a* is detached and another attachment 30 is attached to the quick hitch 16. This makes it possible to perform work other than excavation (or some other excavation work) using the other attachment 30.

Examples of attachments 30 other than the bucket 30*a* include pallet forks, skid cutters, crushers, breakers, angle brooms, earth augers, grapple, sweepers, mowers, snow blowers, and spreaders. Attachments 30 of each type may have different specifications such as sizes and/or shapes.

FIG. 1 is a block diagram of an attachment usage system 100 and the working vehicle 1 according to the present example embodiment. The attachment usage system 100 includes the working vehicle(s) 1 and attachment(s) 30. The example in FIG. 1 includes one working vehicle 1 and two attachments 30, but the number of working vehicles 1 and the number of attachments 30 included in the attachment usage system 100 may be selected appropriately.

The working vehicle 1 includes a controller 21, one or more nonvolatile memories 22, a beacon scanner 23, a communicator 24, a user interface (indicated as "UI" in FIG. 1) 25, a battery 20, switches (each indicated as "SW" in FIGS. 1) 26 to 29, and/or the like.

The controller 21 includes, for example, an information processor circuit including CPU(s) and memory (memories). Specifically, the controller 21 includes a processor or a computer. The controller 21 is configured or programmed to control operation of elements of the working vehicle 1. The controller 21 includes an internal memory 21*a* (first memory) which is a volatile memory or a nonvolatile memory. The controller 21 may, for example, use a predetermined storage area of the internal memory 21*a* which is a volatile memory as a buffer for temporary storage of information and data.

The one or more nonvolatile memories 22 (second memory, third memory) are provided externally to the controller 21. The internal memory 21*a* and the nonvolatile memory 22 store software program(s) and control data for the controller 21 to control operation of the elements. The nonvolatile memory 22 stores pieces of control data corresponding to various attachments 30.

The beacon scanner 23 is a receiver to receive wireless signals (beacon signals) compliant with Bluetooth (registered trademark) Low Energy which is a near field communication standard. The beacon scanner 23 measures the received signal strength indicator (RSSI, received signal strength) of the received wireless signals.

The communicator 24 includes an electric circuit (communication interface) for communication via at least one of wireless LAN, near field communication, the Internet, or the like. The communicator 24 communicates with the portable device 70 in a wireless manner. The portable device 70 is a smartphone, a tablet computer, and/or the like. The user interface 25 includes an input and an output, and includes, for example, a touchscreen (touch panel) including a display and/or the like. For another example, the user interface 25 may include an input and an output (display) provided independently of each other.

The battery 20 supplies electricity to electric equipment in and/or on the working vehicle 1. The attaching switch 26, the detaching switch 27, the auxiliary mode switch 28, and the auxiliary output switch 29 are respective operation switches to be operated by the user of the working vehicle 1. The attaching switch 26 and the detaching switch 27 are momentary operation switches. The user interface 25 and the switches 26 to 29 are provided operably in the vicinity of the seat 8 in the cabin 3.

The attaching switch 26 is operated to attach the attachment 30 to the quick hitch 16. The detaching switch 27 is operated to allow the attachment 30 to be detached from the quick hitch 16. The auxiliary mode switch 28 is operated to start an auxiliary mode in which specific attachment(s) 30 are usable. The auxiliary output switch 29 is operated to supply (transmit) hydraulic fluid as power to the hydraulic fluid outlet port 18*a*.

The working vehicle 1 includes, as hydraulic-related features, a main pump P1, a pilot pump P2, a control valve unit (indicated as "CVU" in FIG. 1) 40, a proportional valve 41, a regulator 42, sensors 43 and 44, hydraulic actuators 14, 15, 46L, 46R, and 52, fluid passage(s), a tank, and/or the like. The main pump P1 and the pilot pump P2 are driven by power from a prime mover 9 to deliver hydraulic fluid sucked from the tank to fluid passage(s). The prime mover 9 includes, for example, an engine. For another example, the prime mover 9 may include an electric motor.

The main pump P1 is a variable displacement hydraulic pump. The regulator 42 changes the angle of the swash plate of the main pump P1. The controller 21 controls the opening of the proportional valve 41 to apply pilot pressure, which is the hydraulic pressure of hydraulic fluid delivered by the pilot pump P2, to the regulator 42. The controller 21 then actuates the regulator 42 to change the angle of the swash plate of the main pump P1 to change the amount of hydraulic fluid delivered by the main pump P1. Operating equipment 47 includes the travel operator 6 and work operator 7, operating valves corresponding to the travel operator 6 and the work operator 7, switching valve(s), and the like.

The control valve unit 40 allows hydraulic fluid supplied from the main pump P1 through fluid passage(s) to flow to the boom cylinders 14 and the front cylinders 15 of the working device 4, the latch cylinder 52 of the quick hitch 16, and the hydraulic fluid outlet port 18*a*. The control valve unit 40 also allows hydraulic fluid that flows from the boom cylinders 14, the front cylinders 15, the latch cylinder 52, and the hydraulic fluid inlet port 18*b* (return fluid) to be discharged. The control valve unit 40 controls the direction and amount of supply of hydraulic fluid to the boom cylinders 14, the front cylinders 15, and the latch cylinder 52. The control valve unit 40 also controls the amount of supply of hydraulic fluid to the hydraulic fluid outlet port 18*a*.

Specifically, the control valve unit 40 includes control valves 40*a*, 40*b*, 40*c*, and 40*d* corresponding to the boom cylinders 14, the front cylinders 15, the latch cylinder 52, and the ports 18*a* and 18*b*. Each of the control valves 40*a*, 40*b*, 40*c*, and 40*d* is switchable between a neutral position, a first position, and a second position. At least the control valves 40*c* and 40*d*, corresponding to the latch cylinder 52 and the ports 18*a*, 18*b*, of the control valves 40*a*, 40*b*, 40*c*, and 40*d* are electrically actuated solenoid valves. The control valves 40*a*, 40*b*, 40*c*, and 40*d* are normally held in the neutral position by the elastic force of a spring.

The operating equipment 47 includes the work operator 7 and work operating valves corresponding to the work operator 7. The work operating valve(s) is/are actuated according to the manner in which the work operator 7 is operated, thus allowing the pilot pressure of pilot fluid from the pilot pump P2 to act on pressure receiver(s) of the corresponding control valve(s) 40*a* and/or 40*b* via the actuated work operating valve(s). For example, the work operator 7 may be supported on the work operating valves and the work operating valves may be physically actuated by operation of the work operator 7. Additionally or alternatively, a detection sensor to detect the amount (degree) and direction of operation of the work operator 7 may be provided and the controller 21 may electrically actuate the work operating valve(s) based on the detection result from the detection sensor.

With this, the control valve(s) 40*a* and/or 40*b* is/are switched from the neutral position to the first position or the second position, so that hydraulic fluid from the main pump P1 is supplied through the control valve(s) 40*a* and/or 40*b* to the boom cylinders 14 and/or the front cylinders 15 to cause the boom cylinders 14 and/or the front cylinders 15 to extend or retract. It follows that the booms 11 and/or the attachment 30 such as the bucket 30*a* attached to the quick hitch 16 swing.

The pilot pressure (work operating pressure) acting on the pressure receivers of the control valves 40*a* and 40*b* from the work operating valves of the operating equipment 47 is detected by pressure sensors 49*a*. Although only a single pressure sensor 49*a* is illustrated in FIG. 1, actually, multiple pressure sensors 49*a* (for example, four pressure sensors 49*a*) are connected to respective fluid passages (for example, four fluid passages) to supply pilot fluid to respective pressure receivers of the control valves 40*a* and 40*b* (for example, two pressure receivers of the control valve 40*a* and two pressure receivers of the control valve 40*b*). The controller 21 determines the operation state of the work operating valves and the work operator 7 of the operating equipment 47 based on the pilot pressure detected by the pressure sensors 49*a*.

For another example, detection sensor(s) such as potentiometer(s) to detect the angle of rotation of the work operator 7, etc., may be provided instead of the pressure sensors 49*a*. The controller 21 may determine the operation state of the work operating valves and the work operator 7 of the operating equipment 47 based on output signal(s) from the detection sensor(s). Such detection sensors and pressure sensors 49*a* are examples of work operation sensors to detect the operation state of the work operator 7, and the work operation sensors are not limited to those described above. In a case that the work operator 7 is an electric work operator, such as a joystick, to output an electric signal (operation signal) corresponding to the operation state, the controller 21 may determine the operation state of the work operator based on the electric signal.

The pressure of hydraulic fluid supplied from the control valves 40*a* and 40*b* to the boom cylinders 14 and the front cylinders 15, i.e., the supply pressure of hydraulic fluid to the boom cylinders 14 and the supply pressure of hydraulic fluid to the front cylinders 15, are detected by pressure sensors 49*b*. Although only a single pressure sensor 49*b* is illustrated in FIG. 1, actually, multiple pressure sensors 49*b* (for example, two pressure sensors 49*b*) are connected to a fluid passage to supply hydraulic fluid from the control valve 40*a* to the boom cylinders 14 and a fluid passage to supply hydraulic fluid from the control valve 40*b* to the front cylinders 15.

The controller 21 determines the action status (acting state or stopped state) of the working device 4 (including the boom cylinders 14 and front cylinders 15) based on the supply pressure of hydraulic fluid to the boom cylinders 14 and the supply pressure of hydraulic fluid to the front cylinders 15 detected by the pressure sensors 49*b*. The controller 21 regards the supply pressure of hydraulic fluid to the boom cylinders 14 and the supply pressure of hydraulic fluid to the front cylinders 15 as loads on the boom cylinders 14 and the front cylinders 15, and regards the greater of the supply pressures as the load on the working device 4.

For another example, detection sensor(s) to detect the angle of rotation achieved by the boom cylinders 14 and the front cylinders 15, and vibration, acceleration, and/or the like of the boom cylinders 14 and the front cylinders 15 may be provided instead of the pressure sensors 49*b*. Such detection sensors and pressure sensors 49*b* are examples of work detection sensors to detect the action status of the boom cylinders 14 and the front cylinders 15, and the work detection sensors are not limited to those described above. In a case that the control valves 40*a* and 40*b* are solenoid valves, the controller 21 may determine the action status of the working device 4 based on the switching positions of the control valves 40*a* and 40*b* controlled by the controller 21.

Of the switches 26 to 29 connected to the controller 21, while the attaching switch 26 is being operated, the controller 21 places the control valve 40*c* in the first position to allow hydraulic fluid from the main pump P1 to be supplied to the latch cylinder 52 in the first direction to cause the latch cylinder 52 to extend. Accordingly, the operation of the attaching switch 26 that lasts for a predetermined period of time or more while the latching mechanisms 51 are in the unlatching state causes the latch cylinder 52 to extend to the predetermined degree or more, bringing the latching mechanisms 51 into the latching state.

Even if the attaching switch 26 is operated, provided that the operation only lasts for a period less than the predetermined period of time, the latch cylinder 52 does not extend to the predetermined degree or more and therefore the latching mechanisms 51 are not brought into the latching state. Therefore, the latching mechanisms 51 are moved back by the spring back force of the coil springs 56 to the original unlatching state.

On the contrary, while the detaching switch 27 is being operated, the controller 21 places the control valve 40*c* in the second position to allow hydraulic fluid from the main pump P1 to be supplied to the latch cylinder 52 in a second direction opposite to the first direction to cause the latch cylinder 52 to retract. Accordingly, the operation of the detaching switch 27 that lasts for a predetermined period of time or more while the latching mechanisms 51 are in the latching state causes the latch cylinder 52 to retract to a predetermined degree or more, bringing the latching mechanisms 51 into the unlatching state.

Even if the detaching switch 27 is operated, provided that the operation only lasts for a period less than the predetermined period of time, the latch cylinder 52 does not retract to the predetermined degree or more and therefore the latching mechanisms 51 are not brought into the unlatching state. Therefore, the latching mechanisms 51 are moved back by the spring back force of the coil springs 56 to the original latching state. The controller 21 determines whether the latching mechanisms 51 are in the latching state or the unlatching state based on, for example, the position of the control valve 40*c*.

The predetermined periods of time for the switches 26 and 27 are each, for example, about 2 to 3 seconds. The predetermined periods of time for the switches 26 and 27 may be the same period or different periods. The specific values of the predetermined periods of time are examples, and not limited to the values above. The specific values of another predetermined period of time and a period of time (described later) are also examples and not limited thereto.

When the auxiliary mode switch 28 is operated and the auxiliary mode is selected, a specific attachment 30 is attached to the quick hitch 16. The hydraulic fluid outlet port 18*a* and a hydraulic fluid inlet port 38*b* of the specific attachment 30*b* are connected together by a hose, and the hydraulic fluid inlet port 18*b* and a hydraulic fluid outlet port 38*a* of the specific attachment 30*b* are connected together by a hose.

Upon operation of the auxiliary output switch 29 under such circumstances, the controller 21 switches the control valve 40*d* from the neutral position to the first position or the second position to allow the attachment 30 attached to the quick hitch 16 to be actuated. With this, hydraulic fluid from the main pump P1 is supplied (transmitted) through a fluid passage 45*a* to the hydraulic fluid outlet port 18*a*, and hydraulic fluid flowing into a fluid passage 45*b* from the hydraulic fluid inlet port 18*b* is drained through the control valve unit 40.

The hydraulic fluid discharged through the hydraulic fluid outlet port 18*a* is introduced into the specific attachment 30*b* through the hydraulic fluid inlet port 38*b* via a hose or the like. Furthermore, hydraulic fluid (return fluid) discharged through the hydraulic fluid outlet port 38*a* of the specific attachment 30*b* is introduced through the hydraulic fluid inlet port 18*b* via a hose or the like and is drained from the control valve unit 40. Since hydraulic fluid is introduced and discharged to and from the specific attachment 30*b* as such, hydraulic actuators 36 such as a hydraulic motor and/or hydraulic cylinder(s) of the attachment 30*b* are actuated, making it possible to perform work using the attachment 30*b*.

When allowing hydraulic fluid to be introduced and discharged to and from the specific attachment 30*b*, the controller 21 changes the opening of the control valve 40*d* depending on what specific attachment 30*b* is attached to the quick hitch 16, to adjust the flow rate or hydraulic pressure of hydraulic fluid supplied to the hydraulic fluid outlet port 18*a*. For example, the controller 21 may cause the flow rate sensor 43 to detect the flow rate of hydraulic fluid flowing through the fluid passage 45*a* and control the opening of the control valve 40*d*. Additionally or alternatively, the controller 21 may cause the pressure sensor 44 to detect the hydraulic pressure of hydraulic fluid flowing through the fluid passage 45*a* and control the opening of the control valve 40*d*. The controller 21 may determine the point in time at which the attachment 30 attached to the quick hitch 16 is actuated based on output signal(s) from at least one of the flow rate sensor 43, the pressure sensor 44, or the auxiliary output switch 29.

The pair of left and right traveling devices 5 include a pair of left and right hydro-static transmissions (HSTs) 46L and 46R corresponding to the pair of left and right traveling devices 5. Each of the HSTs 46L and 46R includes hydraulic pump(s) and a travel motor (hydraulic motor).

The operating equipment 47 includes the travel operator 6 and travel operating valves corresponding to the travel operator 6. The travel operating valve(s) is/are actuated according to the manner in which the travel operator 6 is operated, thus allowing the pilot pressure of pilot fluid from the pilot pump P2 to act on pressure receiver(s) of the hydraulic pump(s) of the corresponding HST(s) 46L and/or 46R via the actuated travel operating valve(s) and changing the angle of inclination of swash plate(s) of the hydraulic pump(s). For example, the travel operator 6 may be supported on the travel operating valves and the travel operating valves may be physically actuated by operation of the travel operator 6. Additionally or alternatively, a detection sensor to detect the amount (degree) and direction of operation of the travel operator 6 may be provided and the controller 21 may electrically actuate the travel operating valve(s) based on the detection result from the detection sensor.

This controls the supply, the stopping of supply, and the direction of supply of hydraulic fluid from the hydraulic pump(s) of the HSTs 46L and/or 46R to the travel motor(s), the travel motor(s) rotate(s) in the forward direction, rotate in the reverse direction, or stop, the left and/or right traveling device(s) 5 also rotate(s) in the forward direction, rotate in the reverse direction, or stop, and the working vehicle 1 travels forward, rearward, turn left or right, or stops.

The operating equipment 47 includes a travel switching valve for speed change. The position of the travel switching valve is switched in response to a control signal from the controller 21, thus changing the angle of inclination of the swash plate(s) of the travel motor(s) of the HSTs 46L and/or 46R. With this, the rotation speed of the travel motor(s) increases or decreases, so that the travel speed of the traveling devices 5 and the working vehicle 1 is changed.

The pilot pressure (travel operating pressure) acting on the pressure receivers of the hydraulic pumps of the HSTs 46L and 46R from the travel operating valves of the operating equipment 47 is detected by pressure sensors 48*a*. Although only a single pressure sensor 48*a* is illustrated in FIG. 1, actually, multiple pressure sensors 48*a* (for example, four pressure sensors 48*a*) are connected to respective fluid passages (for example, four fluid passages) to supply pilot fluid to respective pressure receivers of the hydraulic pumps of the HSTs 46L and 46R (for example, two pressure receivers of the hydraulic pump of the HST 46L and two pressure receivers of the hydraulic pump of the HST 46R). The controller 21 determines the operation state of the travel operating valves and the travel operator 6 of the operating equipment 47 based on the pilot pressure detected by the pressure sensors 48*a*.

For another example, detection sensor(s) such as potentiometer(s) to detect the angle of rotation of the travel operator 6, etc., may be provided instead of the pressure sensors 48*a*. The controller 21 may determine the operation state of the travel operating valves and the travel operator 6 of the operating equipment 47 based on output signal(s) from the detection sensor(s). Such detection sensors and pressure sensors 48*a* are examples of travel operation sensors to detect the operation state of the travel operator 6, and the travel operation sensors are not limited to those described above. In a case that the travel operator 6 is an electric travel operator, such as a joystick, to output an electric signal (operation signal) corresponding to the operation state, the controller 21 may determine the operation state of the travel operator based on the electric signal.

The pressure of hydraulic fluid supplied from the hydraulic pumps of the HSTs 46L and 46R to the travel motors, i.e., the travel pressure for the left traveling device 5 and the travel pressure for the right traveling device 5, are detected by pressure sensors 48*b*. Although only a single pressure sensor 48*b* is illustrated in FIG. 1, actually, multiple pressure sensors 48*b* (for example, four pressure sensors 48*b*) are connected to fluid passages (supply fluid passage and return fluid passage) to allow hydraulic fluid to circulate between the hydraulic pump of the HST 46L and the travel motor corresponding to the left traveling device 5 and fluid passages (supply fluid passage and return fluid passage) to allow hydraulic fluid to circulate between the hydraulic pump of the HST 46R and the travel motor corresponding to the right traveling device 5.

The controller 21 determines the action status (traveling forward/rearward, turning, and stopping) of the traveling devices 5 (left traveling device 5 and right traveling device 5) based on the travel pressure detected by the pressure sensors 48*b*. The controller 21 may cause rotation speed sensors 48*c* to detect the rotation speed of the travel motors of the HSTs 46L and 46R instead of the pressure sensors 48*b*, and determine the action status of the traveling devices 5 based on the detection result. The rotation speed sensors 48*c* and the pressure sensors 48*b* are examples of travel detection sensors to detect the action status of the traveling devices 5, and the travel detection sensors are not limited to those described above.

The attachment 30 attachable to the working vehicle 1 is provided with a beacon transmitter 33. The beacon transmitter 33 is a transmitter to periodically transmit an advertisement signal (also called "advertisement packet" or "beacon signal") which is a wireless signal compliant with Bluetooth (registered trademark) Low Energy. The beacon transmitter 33 looks like a small tag, and is therefore sometimes called a "BLE tag". The beacon transmitter 33 includes a microcomputer, a memory, a transmitter circuit, a battery, a vibration sensor 34, and/or the like. The elements of the beacon transmitter 33 are driven by electricity from the battery. The beacon transmitter 33 transmits the advertisement signal at interval(s) of, for example, about 1 second to about 3 seconds, but the intervals are not limited to 1 second to 3 seconds and may be selected as appropriate.

Figure 2:
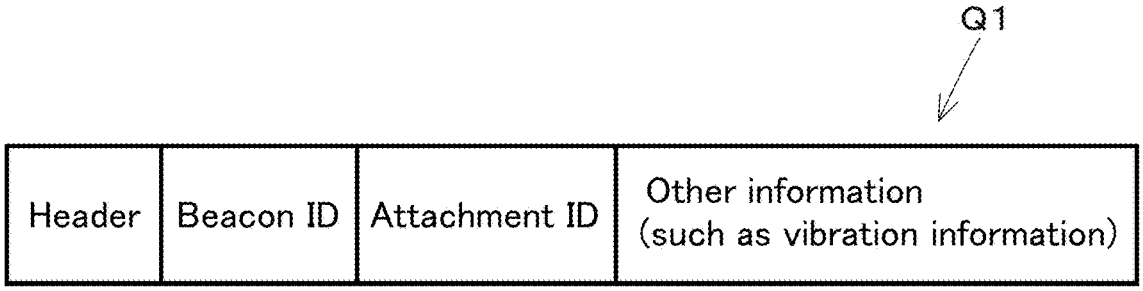
FIG. 2 is a diagram showing an example of information included in an advertisement signal.

FIG. 2 shows an example of information contained in an advertisement signal Q1 transmitted from the beacon transmitter 33. The advertisement signal Q1 includes a header, a beacon ID, an attachment ID, and other information. The beacon ID is identification information of the beacon transmitter 33 which is the sender of the advertisement signal Q1. The attachment ID is identification information of the attachment 30 in or on which the beacon transmitter 33 which is the sender of the advertisement signal Q1 is provided.

The other information in the advertisement signal Q1 includes vibration information relating to the vibration state detected by the vibration sensor 34 of the beacon transmitter 33 which is the sender, i.e., vibration information relating to the vibration state of the attachment 30 in or on which the beacon transmitter 33 is provided. The vibration information may include information such as a message indicating whether or not the attachment 30 is vibrating (presence or absence of vibration). The vibration information may include, instead of or in addition to the information such as a message, a vibration indicator (numerical value) indicating the magnitude of vibration detected by the vibration sensor 34. The vibration indicator may be, for example, at least one of the displacement, velocity, or acceleration of vibrations of the attachment 30 detected by the vibration sensor 34. Inertial sensor(s) such as an acceleration sensor and/or a gyroscope sensor may be used as the vibration sensor 34.

As illustrated in FIG. 18, the beacon transmitter 33 is located on, for example, the back surface of the attachment 30 that faces the vehicle body 2 of the working vehicle 1. The beacon scanner 23 is located at, for example, the front portion of the vehicle body 2 that faces the attachment 30. The controller 21 is provided in the vehicle body 2. Since the beacon scanner 23 is provided in or on the vehicle body 2, it is possible to achieve a configuration in which output signals from the beacon scanner 23 can be inputted into the controller 21 using simple electric wiring or simple communication circuit(s) as compared to cases where the beacon scanner 23 is provided on the movable working device 4.

The advertisement signal Q1 transmitted from the beacon transmitter 33 is received by the beacon scanner 23 of the working vehicle 1. The controller 21 identifies (recognizes) the attachment 30 provided with the beacon transmitter 33 (sender) based on the attachment ID included in the advertisement signal Q1 received by the beacon scanner 23.

In the case where one or more attachments 30 are present in the vicinity of the working vehicle 1, one or more advertisement signals Q1 from one or more beacon transmitters 33 of the one or more attachments 30 are received by the beacon scanner 23. Upon receipt of each advertisement signal Q1, the beacon scanner 23 measures the RSSI of the advertisement signal Q1.

The controller 21 causes the internal memory (first memory) 21*a* to store, in its predetermined storage area, information included in the advertisement signal Q1 received by the beacon scanner 23 (FIG. 2), thus collecting such information. In so doing, the controller 21 generates advertisement (ADV) information including information included in the advertisement signal Q1, the value indicating the RSSI of the advertisement signal Q1, and time information indicating the receipt time point (date and time) at which the advertisement signal Q1 was received, and causes the internal memory 21*a* to store the ADV information in its predetermined storage area.

FIG. 3 illustrates ADV information stored (collected) in the predetermined storage area of the internal memory 21*a*. In order to keep the capacity of the predetermined storage area of the internal memory 21*a* at a certain level, the controller 21 may delete the ADV information (or overwrite the ADV information with newly generated ADV information) after storing it in the internal memory 21*a* for a period of time.

In the case of attaching an attachment 30 on the ground, etc., to the working vehicle 1, while no attachments 30 are attached to the quick hitch 16, i.e., while the latching mechanisms 51 are in the unlatching state, the user of the working vehicle 1 operates the travel operator 6 to cause the traveling devices 5 to travel forward to cause the working device 4 to approach the rear portion of the attachment 30. The user operates the work operator 7 along the first direction to actuate the boom cylinders 14 to raise or lower the booms 11 of the working device 4 so that the height of the quick hitch 16 at the distal end of the booms 11 matches the height of the attachment 30. The user operates the work operator 7 along the second direction to actuate the front cylinders 15 so that the angle (tilt) of the front plates 50*f* of the brackets 50 of the quick hitch 16 matches the angle of the base plate 71 of the attachment 30.

Next, the user operates the travel operator 6 to cause the traveling devices 5 to travel forward to some degree at very low speed to cause the front plates 50*f* of the quick hitch 16 to engage with the base plate 71 of the attachment 30 as illustrated in FIG. 20A, thus causing the brackets 50 to hold the attachment 30. In so doing, the user may, after causing the front plates 50*f* to engage with the base plate 71, use the work operator 7 to raise the booms 11 to some degree or cause the quick hitch 16 to swing upward to some degree to cause the working device 4 to lift up the attachment 30 to some degree to check whether the attachment 30 is held by the brackets 50.

As such, the attachment 30 vibrates, for example, when the front plates 50*f* of the brackets 50 engage with the base plate 71, when the attachment 30 is lifted up by the working device 4, and when the attachment 30 is latched by the latching mechanisms 51. The advertisement signal Q1 transmitted by the beacon transmitter 33 in or on the attachment 30 includes vibration information relating to the vibration state of the attachment 30 detected by the vibration sensor 34 when such an instance occurs.

The controller 21 is configured or programmed to, when the attachment 30 is attached to the quick hitch 16, select, as an attachment ID-at-attaching (identification-information-at-attaching, which is identification information selected when an attachment 30 is attached), one of one or more attachment IDs that is included in one of the one or more advertisement signals Q1 received by the beacon scanner 23, according to a predetermined first condition. Note that the that controller 21 may select an attachment ID-at-attaching while the attachment 30 is being attached to the quick hitch 16 or after the attachment 30 is attached to the quick hitch 16.

After that, when the working vehicle 1 takes action, the controller 21 selects, as an attachment ID-at-action (identification-information-at-action, which is identification information selected when, for example, the working vehicle 1 takes action), one of the one or more attachment IDs included in one of the one or more advertisement signals Q1 received by the beacon scanner 23, according to a predetermined second condition. Note that the controller 21 may select an attachment ID-at-action while the working vehicle 1 is in action or after the working vehicle 1 takes action.

The controller 21 is configured or programmed to perform a predetermined process based on at least one of the attachment ID-at-attaching or the attachment ID-at-action. The controller 21 is configured or programmed to determine whether the attachment ID-at-attaching and the attachment ID-at-action are the same as or differ from each other, and output an alert or perform a predetermined process based on the result of the determination.

An example of the predetermined process is a process in which the controller 21 causes the user interface 25 to output (display) information indicating that the attachment 30 corresponding to the attachment ID-at-attaching or the attachment ID-at-action is attached to the quick hitch 16 (working vehicle 1).

Another example of the predetermined process is a process in which the controller 21 controls output of hydraulic fluid (power) to the attachment 30 attached to the quick hitch 16 (controls start and stop of the supply of hydraulic fluid to the attachment 30) according to the attachment ID-at-attaching or the attachment ID-at-action. It is noted here that the controller 21 may also control at least one of the introduction of hydraulic fluid from the attachment 30, the amount of hydraulic fluid supplied to the attachment 30, or the pressure of hydraulic fluid supplied to the attachment 30.

Display data and control data are pre-set for each of the attachment IDs of attachments 30 attachable to the quick hitch 16, i.e., attachments 30 which can be used with the working vehicle 1.

FIG. 4 is a table showing an example of the relationship between the attachment IDs of the attachments 30 attachable to the quick hitch 16 and pieces of display data corresponding to the attachments 30. A piece of display data is data based on which the user interface 25 displays information about a corresponding attachment 30. The display data includes, for example, an icon, name, and specifications of the corresponding attachment 30. Such an attachment ID and display data of the attachment 30 are stored in a predetermined storage area of the nonvolatile memory 22 such that the attachment ID and the display data of the attachment 30 are associated with each other. Note that display data other than that described above may be stored in the nonvolatile memory 22 such that the display data is associated with the attachment ID.

FIG. 5 is a table showing an example of the relationship between the attachment IDs of the attachments 30 attachable to the quick hitch 16 and pieces of control data corresponding to the attachments 30. A piece of control data indicates control performed by the working vehicle 1 according to what attachment 30 is used. The control data includes, for example, the level of the amount of hydraulic fluid supplied to the corresponding attachment 30. Such an attachment ID and control data of the attachment 30 are stored in a predetermined storage area of the nonvolatile memory 22 such that the attachment ID and the control data of the attachment 30 are associated with each other. Note that other control data, such as the level of hydraulic pressure outputted to the attachment 30 and/or the output value of power other than hydraulic fluid, may be stored in the nonvolatile memory 22 such that the control data is associated with the attachment ID.

Figure 6:
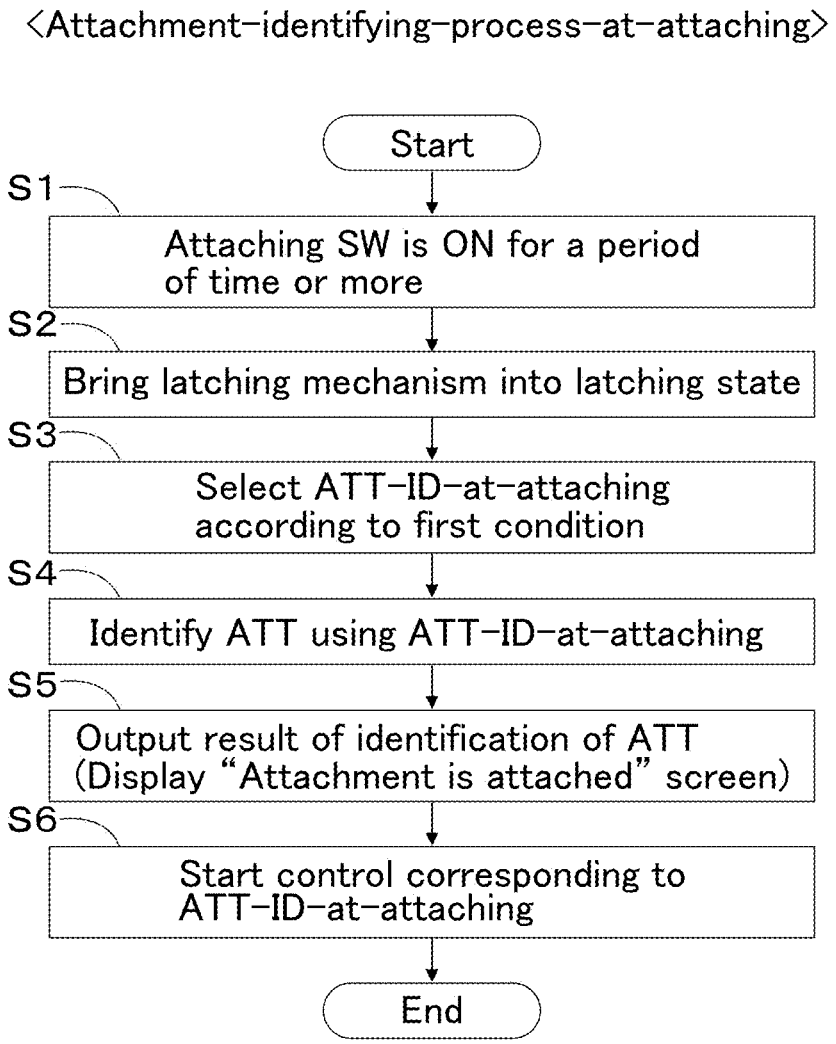
FIG. 6 is a flowchart showing an example of an attachment-identifying-process-at-attaching.

FIG. 6 is a flowchart showing an example of an attachment-identifying-process-at-attaching. The attachment-identifying-process-at-attaching is performed by the controller 21 of the working vehicle 1 based on software program(s) stored in the internal memory 21*a* and/or the nonvolatile memory 22. The same applies to an attachment-identifying-process-at-action described later. In the flowchart in FIG. 6, the advertisement signal Q1 is referred to as "ADV signal" and the attachment is referred to as "ATT" for convenience of description. The same applies to the other flowcharts described later.

If the attaching switch 26 is operated (turned on) continuously for a predetermined period of time or more (S1), the controller 21 causes the latch cylinder 52 to extend to bring the latching mechanisms 51 into the latching state (S2). With this, the attachment 30 is attached to the quick hitch 16 and the working vehicle 1.

The controller 21 selects, as an attachment ID-at-attaching (identification-information-at-attaching), an attachment ID included in one of advertisement signals Q1 received by the beacon scanner 23 according to a first condition (S3).

It is noted here that, for example, the first condition includes a condition in which the controller 21 selects, as the attachment ID-at-attaching, an attachment ID included in an advertisement signal Q1, which is the highest in terms of RSSI, of the advertisement signal(s) Q1 that are received by the beacon scanner 23 in a predetermined period (e.g., 30 seconds) which ends when the attaching switch 26 is operated and that are higher in terms of RSSI than a predetermined value and include vibration information indicating that the attachment 30 is vibrating.

More specifically, for example, the controller 21 reads pieces of information included in piece(s) of ADV information (FIG. 3) collected (stored) in the nonvolatile memory 22, and extracts piece(s) of ADV information that correspond to advertisement signal(s) Q1 which are received by the beacon scanner 23 in a predetermined period which ends when the attaching switch 26 is operated and that include an RSSI higher than a predetermined value and vibration information indicating that the attachment 30 is vibrating. Next, the controller 21 selects, as an attachment ID-at-attaching, an attachment ID included in piece(s) of ADV information including the highest RSSI among the extracted piece(s) of ADV information.

Note that, if there are a plurality of pieces of ADV information that include the highest RSSI, the controller 21 selects, as the attachment ID-at-attaching, an attachment ID included in a piece of ADV information that includes the latest time information.

The first condition described above is merely an example, and the first condition is not limited to those described above. For example, the advertisement signal Q1 receiving period may be changed appropriately. Specifically, for example, the first condition may include a condition concerning the advertisement signal Q1 receiving period, which involves selecting advertisement signals Q1 that are received by the beacon scanner 23 in at least one of (i) a preset period of time (third time period) which ends when the attaching switch 26 is operated or when the attaching switch 26 has been operated continuously for a predetermined period of time or more or (ii) a preset period of time (fourth time period) which starts when the attaching switch 26 is operated or when the attaching switch 26 has been operated continuously for the predetermined period of time or more.

The first condition may include at least one of (i) a condition in which an RSSI higher than a predetermined value is included, (ii) a condition in which vibration information indicating that the attachment 30 is vibrating is included, or (iii) a condition in which the highest RSSI is included. The first condition may include condition(s) relating to at least one of the RSSI of advertisement signal(s) Q1 or information included in the advertisement signal Q1 other than those described above.

The first condition may include condition(s) relating to the number of times of reception of at least one of the beacon ID or attachment ID included in an advertisement signal Q1. For example, the first condition may include a condition in which the attachment ID included in an advertisement signal Q1 has been received a predetermined number of times or more, a condition in which the attachment ID has been received consecutively a predetermined number of times or more, and/or a condition in which the attachment ID has been received most. The conditions described above may be used in combination as the first condition. The conditions described above are examples, and the first condition may include some other condition(s).

After selecting the attachment ID-at-attaching, the controller 21 identifies (recognizes) an attachment 30 attached to the quick hitch 16 based on the attachment ID-at-attaching (S4). In so doing, the controller 21 identifies the type and other specifications, etc., of the attachment 30 corresponding to the attachment ID-at-attaching.

Next, the controller 21 causes the nonvolatile memory 22 to store the result of identification of the attachment 30, and causes the user interface 25 to display (output) the result of identification (S5, predetermined process). In so doing, the controller 21 causes the user interface 25 to display an "attachment is attached" screen G1 including information indicating that the attachment 30 corresponding to the attachment ID-at-attaching is attached and attachment information indicative of the attachment 30.

Figure 7:
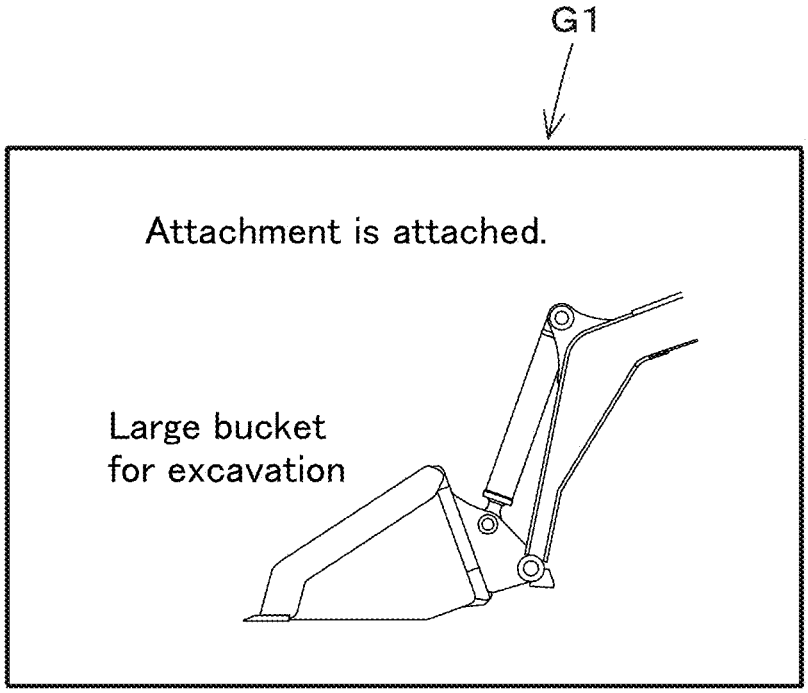
FIG. 7 illustrates an example of an "attachment is attached" screen.

FIG. 7 illustrates an example of the "attachment is attached" screen G1. The "attachment is attached" screen G1 displays a message indicating that the attachment 30 is attached, the attachment information relating to the attached attachment 30, and an icon of the attachment 30. In the example in FIG. 7, the attachment information "Large bucket" "for excavation" is displayed. Additionally or alternatively, other attachment information such as the attachment ID, size, and/or manufacturer of the attachment 30 may be displayed. The display data for the "attachment is attached" screen G1 and the attachment information are prestored in the nonvolatile memory 22 (see FIG. 4).

For another example, the controller 21 may cause the communicator 24 (FIG. 1) to transmit, to the portable device 70, the display data for the "attachment is attached" screen G1 and the attachment information of the attachment 30 which has been determined as being attached so that the "attachment is attached" screen G1 is displayed on a display of the portable device 70.

The controller 21 starts (performs) a predetermined control (predetermined process) based on the attachment ID-at-attaching (S6). In so doing, the controller 21 reads control data (FIG. 5) corresponding to the attachment ID-at-attaching form the nonvolatile memory 22 and starts control corresponding to the attachment 30 attached to the quick hitch 16 based on the control data.

Specifically, in the case where the attachment 30 attached to the quick hitch 16 is an attachment 30*b* including a hydraulic actuator such as a skid cutter, the controller 21 starts causing the control valve 40*d* to control the output of hydraulic fluid from the hydraulic fluid outlet port 18*a* to the attachment 30*b*, based on the control data read from the nonvolatile memory 22. With this, draining of return fluid to be introduced from the attachment 30*b* into the hydraulic fluid inlet port 18*b* is also started. The controller 21 may, for example, cause the "attachment is attached" screen G1 to display a message indicating that the control of the output of hydraulic fluid to the attachment 30*b* has been started.

Note that, in the case where the attachment 30 attached to the quick hitch 16 is an attachment 30 including no hydraulic actuators such as a bucket 30*a*, the controller 21 does not cause the control valve 40*d* to output hydraulic fluid from the hydraulic fluid outlet port 18*a* to the attachment 30 based on the control data read from the nonvolatile memory 22. The controller 21 may start control such as adjusting and/or limiting the travel speed and/or speed stage of the working vehicle 1 and/or the height of the raised/lowered booms 11 based on the attachment ID-at-attaching in step S6 in FIG. 6. After performing step S6, the controller 21 ends the attachment-identifying-process-at-attaching.

Figure 8:
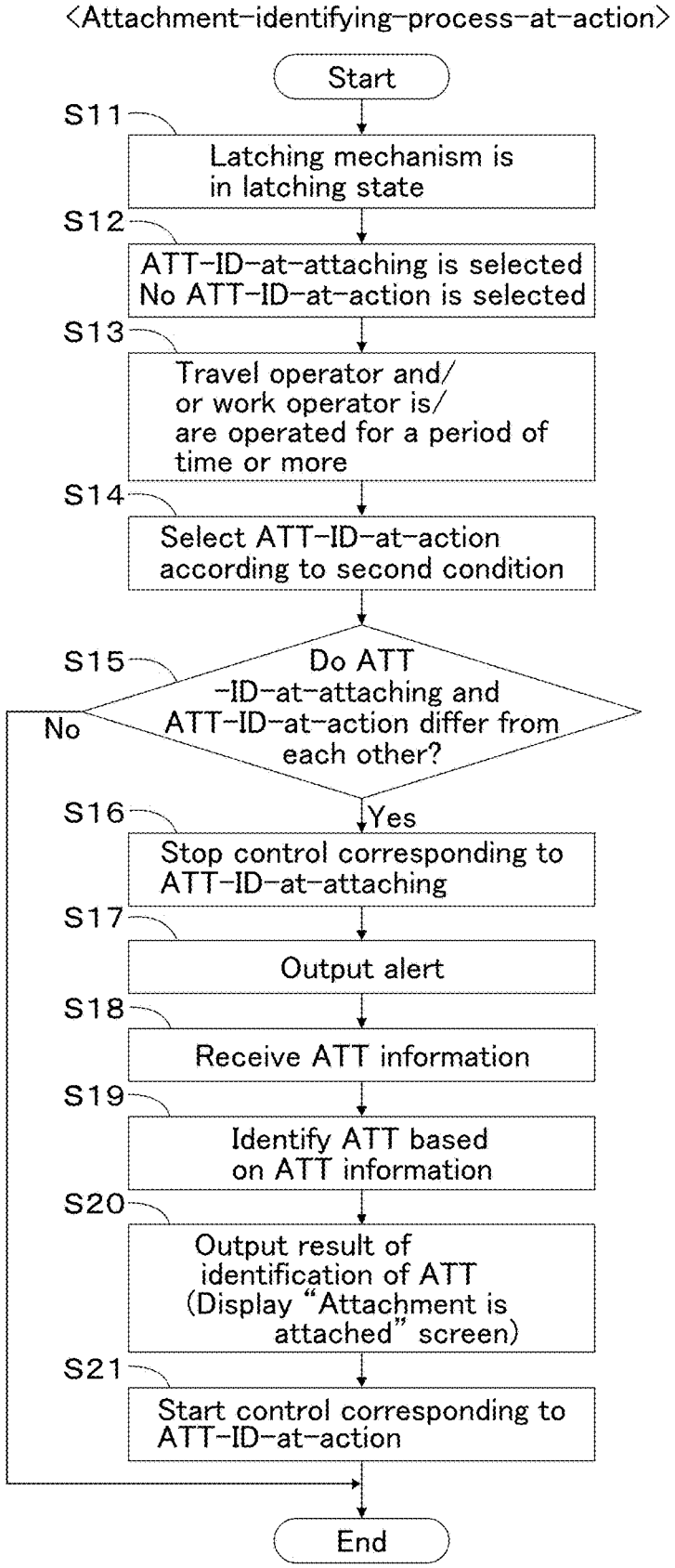
FIG. 8 is a flowchart showing an example of an attachment-identifying-process-at-action.

FIG. 8 is a flowchart showing an example of the attachment-identifying-process-at-action. After the ending the attachment-identifying-process-at-attaching, the controller 21 starts the attachment-identifying-process-at-action.

The controller 21 detects that the latching mechanisms 51 are in the latching state (S11), and detects that the attachment ID-at-attaching is selected but no attachment ID-at-action is selected (S12). Next, upon detecting that at least one of the travel operator 6 or the work operator 7 has been operated continuously for a predetermined period of time or more (S13), the controller 21 determines that the traveling device 5 and/or the working device 4 is/are about to take action.

The controller 21 selects, as an attachment ID-at-action (identification-information-at-action), an attachment ID included in one of the advertisement signal(s) Q1 received by the beacon scanner 23, according to a second condition (S14).

It is noted here that, for example, the second condition may include a condition in which the controller 21 selects advertisement signals Q1 that are received by the beacon scanner 23 in (i) a period during which at least one of the travel operator 6 or the work operator 7 is being operated or (ii) a period from a first point in time to a second point in time, the first point in time being a point in a first time period (e.g., 2 seconds) before when at least one of the travel operator 6 or the work operator 7 is operated, the second point in time being a point in a second time period (e.g., 2 seconds) after when the at least one of the travel operator 6 or the work operator 7 stops being operated.

The second condition may include a condition in which the controller 21 selects, from the advertisement signals Q1 selected above, advertisement signals Q1 which are higher in terms of RSSI than a predetermined value and which include vibration information indicating that the attachment 30 is vibrating.

The second condition may include a condition in which the controller 21 extracts, from the advertisement signals Q1 selected above, advertisement signals Q1 that are the same in terms of attachment ID included therein and that have been received a predetermined number of times or more within a predetermined period of time, and selects, as an attachment ID-at-action, an attachment ID included in one of the extracted advertisement signals Q1.

More specifically, for example, the controller 21 reads pieces of information included in pieces of ADV information collected in the nonvolatile memory 22, and selects pieces of ADV information corresponding to the advertisement signals Q1 that were received in a period during which at least one of the operators 6 and 7 is being operated or in a period from the first point in time (the point at a first time period before when at least one of the operators 6 and 7 is operated) to the second point in time (the point at a second time period after when the at least one of the operators 6 and 7 stops being operated). Next, the controller 21 selects pieces of ADV information that include an RSSI higher than a predetermine value and vibration information indicating that the attachment 30 is vibrating, from the selected pieces of ADV information. Next, the controller 21 extracts, from the selected pieces of ADV information, an attachment ID that has been received a predetermined number of times or more within a predetermined period of time, and selects the extracted attachment ID as the attachment ID-at-action.

Note that, if there are a plurality of attachment IDs that have been received a predetermined number of times or more within a predetermined period of time, the controller 21 selects, as the attachment ID-at-action, an attachment ID corresponding to the latest time information.

The second condition described above is merely an example, and the second condition is not limited to those described above. For example, the advertisement signal Q1 receiving period may be changed appropriately. The second condition may only include a condition in which the advertisement signals Q1 to be used are those that are the same in terms of attachment ID included therein and that have been received consecutively a predetermined number of times or more within a predetermined period of time. The second condition may include a condition in which the attachment ID to be selected is the one that has been received most.

The second condition may include at least one of (i) a condition in which an RSSI higher than a predetermined value is included, (ii) a condition in which vibration information indicating that the attachment 30 is vibrating is included, or (iii) a condition in which advertisement signals Q1 are the same in terms of attachment ID included therein and have been received a predetermined number of times or more within a predetermined period of time. The second condition may include condition(s) relating to at least one of the RSSI of advertisement signal(s) Q1, information included in the advertisement signal Q1, or the time of reception and the number of times of reception, other than those described above.

The conditions described above are merely examples, and the second condition may include some other condition(s). The second condition may include at least one of the foregoing examples of the first condition. The first condition may include at least one of the above examples of the second condition. Although the second condition differs from the first condition in the above-described examples, the first condition and the second condition may be the same.

In a case that the first condition and the second condition each include a condition in which the advertisement signal Q1 has an RSSI higher than a predetermined value, the predetermined value may be different between the first condition and the second condition. For example, the first condition may include a condition in which the advertisement signal Q1 has an RSSI higher than a first predetermined value, and the second condition may include a condition in which the advertisement signal Q1 has an RSSI higher than a second predetermined value, and the second predetermined value may be greater than the first predetermined value. That is, the second condition may be stricter (provide higher accuracy in selecting the attachment ID of the attached attachment 30) than the first condition. The second condition may be made stricter than the first condition by including more conditions in the second condition than in the first condition.

Since the controller 21 selects an attachment ID-at-attaching and an attachment ID-at-action according to the above-described first condition and second condition, respectively, it is possible to achieve the correctness of the attachment ID-at-action higher than that of the attachment ID-at-attaching as the identification information of the attached attachment 30.

After selecting the attachment ID-at-action, the controller 21 compares the attachment ID-at-attaching and the attachment ID-at-action. Next, if the attachment ID-at-attaching and the attachment ID-at-action are the same as each other (NO in S15), the controller 21 continues the predetermined control (predetermined process) corresponding to the attachment ID-at-attaching, and ends the attachment-identifying-process-at-action.

If the attachment ID-at-attaching and the attachment ID-at-action differ from each other (YES in S15), the controller 21 stops the predetermined control corresponding to the attachment ID-at-attaching (S16), and causes the user interface 25 to output an alert (S17).

Figure 9:
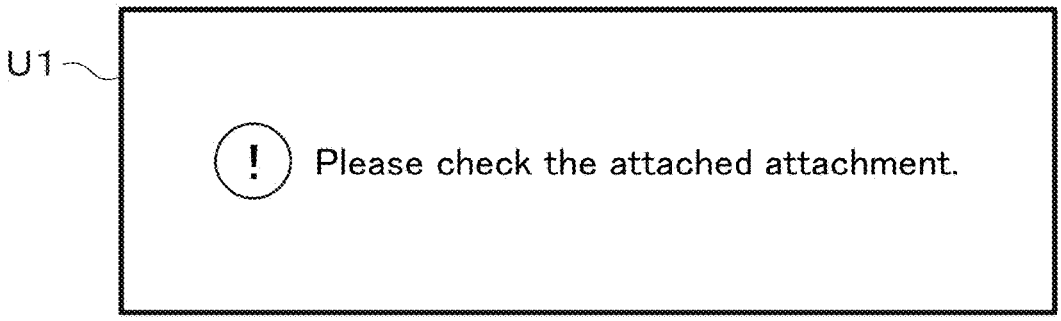
FIG. 9 illustrates an example of an alert window.

Specifically, for example, as illustrated in FIG. 9, the controller 21 causes the user interface 25 to display, on a screen thereof, an alert window U1 including a prompt message (prompt information) requesting to check the attachment 30 attached to the quick hitch 16 in a pop-up manner, etc., as the alert.

The user or the like looks at the message on the alert window U1 and checks the attachment 30 actually attached to the quick hitch 16, and then inputs, via the user interface 25, attachment information indicating the attached attachment 30 (S18 in FIG. 8). With this, the controller 21 identifies the attachment 30 attached to the quick hitch 16 based on the attachment ID corresponding to the inputted attachment information (which is highly likely to be identical to the attachment ID-at-action) (S19). In so doing, the controller 21 identifies the type and other specifications of the attachment 30 corresponding to the attachment ID-at-action.

Next, the controller 21 causes the nonvolatile memory 22 to store the result of identification of the attachment 30, and causes the user interface 25 to display the result of identification (S20, predetermined process). In so doing, the controller 21 causes the user interface 25 to display an "attachment is attached" screen G1 (FIG. 7) including information indicating that the attachment 30 corresponding to the attachment ID-at-action is attached and the attachment information indicative of the attachment 30.

The controller 21 starts a predetermined control based on the attachment ID-at-action (S21), and ends the attachment-identifying-process-at-action. The details of step S21 are the same as step S6 in FIG. 6 described earlier.

After ending the attachment-identifying-process-at-action, the controller 21 may cause the nonvolatile memory 22 to store the attachment ID-at-action as the ID of the attached attachment 30, and delete the attachment ID-at-attaching and the attachment ID-at-action from the nonvolatile memory 22 to deselect (clear) the attachment ID-at-attaching and the attachment ID-at-action. Alternatively, even after ending the attachment-identifying-process-at-action, the controller 21 may keep the attachment ID-at-attaching and the attachment ID-at-action stored in the nonvolatile memory 22, and then, when the detaching switch 27 is operated for a predetermined period of time or more to detach the attachment 30 from the quick hitch 16, delete the attachment ID-at-attaching and the attachment ID-at-action from the nonvolatile memory 22 to deselect the attachment ID-at-attaching and the attachment ID-at-action.

Figure 10:
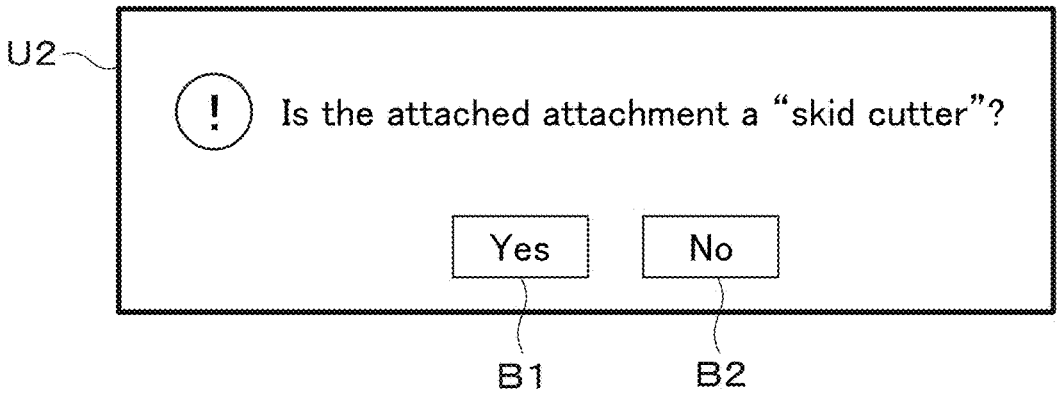
FIG. 10 illustrates another example of an alert window.
Figure 11:
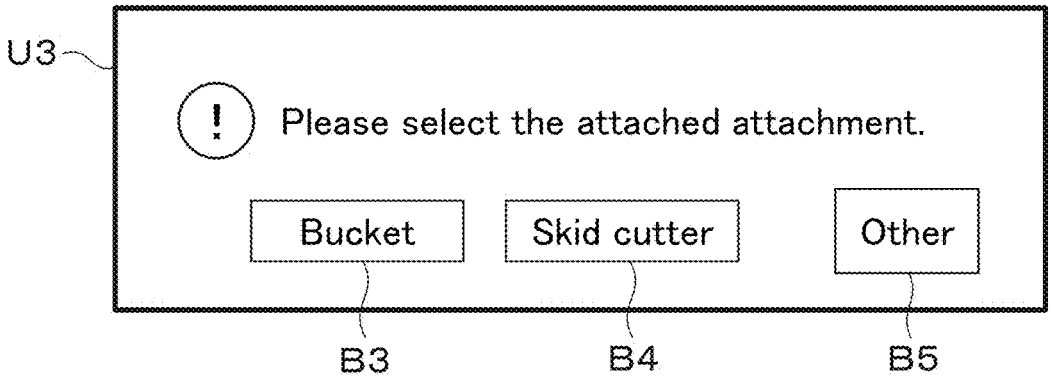
FIG. 11 illustrates a further example of an alert window.

In step S17 of in FIG. 8, the controller 21 may cause the user interface 25 to display, on the screen thereof, an alert window U2 or U3 including the name (attachment information) of the attachment 30 corresponding to at least one of the attachment ID-at-attaching or the attachment ID-at-action and a message asking what attachment 30 is attached, in a pop-up manner, etc., as the alert (see FIGS. 10 and 11, for example).

The alert window U2 in FIG. 10 includes the name ("skid cutter" in FIG. 10) of the attachment 30 corresponding to the attachment ID-at-action, a question message asking whether the attachment 30 is attached or not, and keys B1 and B2 to be operated to answer the question.

When the user or the like confirms that the attachment 30 indicated by the name displayed on the alert window U2 is actually attached to the quick hitch 16 and operates (taps) the "YES" key B1, the name is inputted as the attachment information indicating the attachment 30 (S18 in FIG. 8). With this, the controller 21 identifies the attachment 30 attached to the quick hitch 16 based on the attachment ID-at-action corresponding to the inputted attachment information (S19).

The controller 21 then causes the nonvolatile memory 22 to store the result of identification of the attachment 30, and causes the user interface 25 to display the result of identification (S20). The controller 21 starts a predetermined control based on the attachment ID-at-action (S21), and ends the attachment-identifying-process-at-action.

Figure 12:
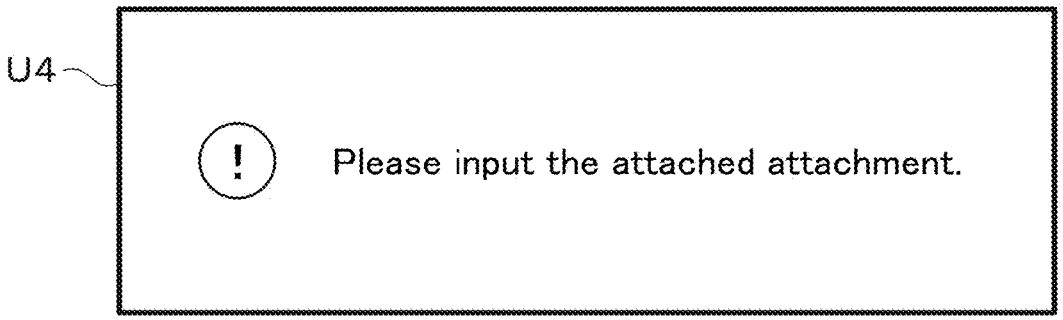
FIG. 12 illustrates still a further example of an alert window.

When the user or the like operates the "NO" key B2 on the alert window U2, for example, the controller 21 may cause the user interface 25 to display, on the screen thereof, an alert window U4 including a prompt message asking for input of information indicating the attachment 30 attached to the quick hitch 16, as illustrated in FIG. 12. The controller 21 may cause the user interface 25 to display, together with the alert window U4, an attachment list L1 including one or more attachments 30 attachable to the quick hitch 16.

FIG. 13 illustrates an example of the attachment list L1. Data of the attachment list L1 is stored in the nonvolatile memory 22. The attachment list L1 displayed by the user interface 25 includes, for example, piece(s) of attachment information including the name(s), attachment ID(s), specifications, and/or the like of the one or more attachments 30 attachable to the quick hitch 16.

The user selects a piece of attachment information indicating the attachment 30 attached to the quick hitch 16 from the attachment list L1 and operates (taps) the row in which the piece of attachment information is displayed, thus inputting the piece of attachment information via the user interface 25 (S18 in FIG. 8). With this, the controller 21 performs steps S19 to S21 as described earlier based on the attachment ID corresponding to the inputted piece of attachment information.

In FIG. 10, the name of the attachment 30 corresponding to the attachment ID-at-action is displayed in the alert window U2. Note, however, that the name of the attachment 30 corresponding to the attachment ID-at-attaching may be displayed in the alert window U2 instead.

The alert window U3 in FIG. 11 includes a question message asking what attachment 30 is attached and keys B3 to B5 to be operated to answer the question. The key B3 is provided with the name ("bucket" in FIG. 11) of the attachment 30 corresponding to the attachment ID-at-attaching. The key B4 is provided with the name ("skid cutter" in FIG. 11) of the attachment 30 corresponding to the attachment ID-at-action. The key B5 is used to select another attachment 30.

When the user or the like operates the key B3, the attachment ID-at-attaching is inputted into the controller 21 as a piece of attachment information (S18 in FIG. 8). When the user or the like operates the key B4, the attachment ID-at-action is inputted into the controller 21 as a piece of attachment information (S18). The controller 21, upon receipt of input of the piece of attachment information in this manner, performs steps S19 to S21 based on the piece of attachment information (attachment ID-at-attaching or the attachment ID-at-action).

The controller 21 may be configured or programmed to, when the user or the like operates the key B5, cause the user interface 25 to display the alert window U4 shown in FIG. 12 and the attachment list L1 shown in FIG. 13. The controller 21 may be configured or programmed to, when the user or the like selects a piece of attachment information indicating the attachment 30 attached to the quick hitch 16 from the attachment list L1 and inputs the piece of attachment information via the user interface 25 (S18 in FIG. 8), perform steps S19 to S21 as described earlier based on the attachment ID corresponding to the inputted piece of attachment information.

For another example, the controller 21 may be configured or programmed to cause the user interface 25 to output, as an alert, information (message) indicating that the attachment ID-at-attaching and the attachment ID-at-action are not the same as each other, e.g., the attachment 30 identified when it is attached and the attachment 30 identified afterward when the working vehicle 1 takes action are not the same as each other. The controller 21 may be configured or programmed to cause an audio output such as a speaker included in the user interface 25 to output an alert using sound, voice and/or the like, in addition to or instead of displaying on a screen.

Figure 14:
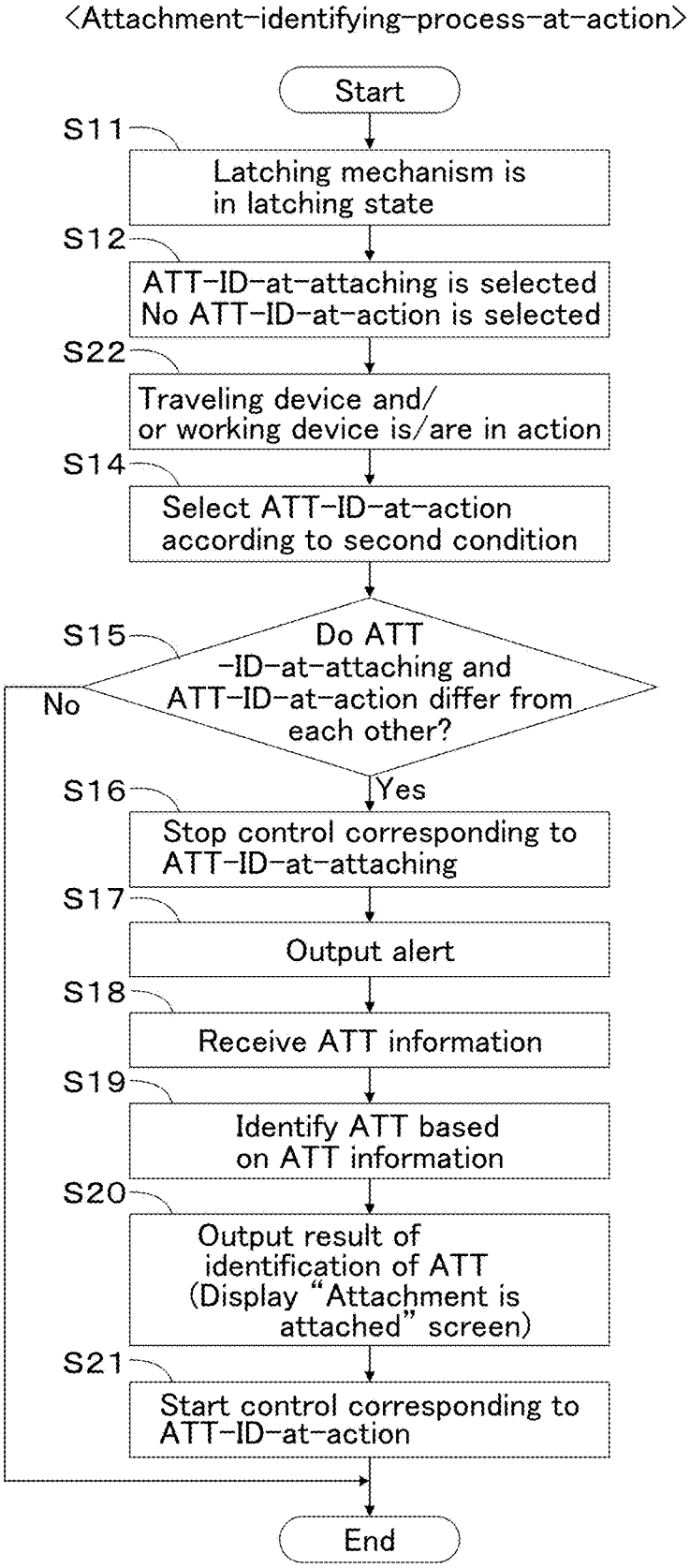
FIG. 14 is a flowchart showing another example of an attachment-identifying-process-at-action.
Figure 15:
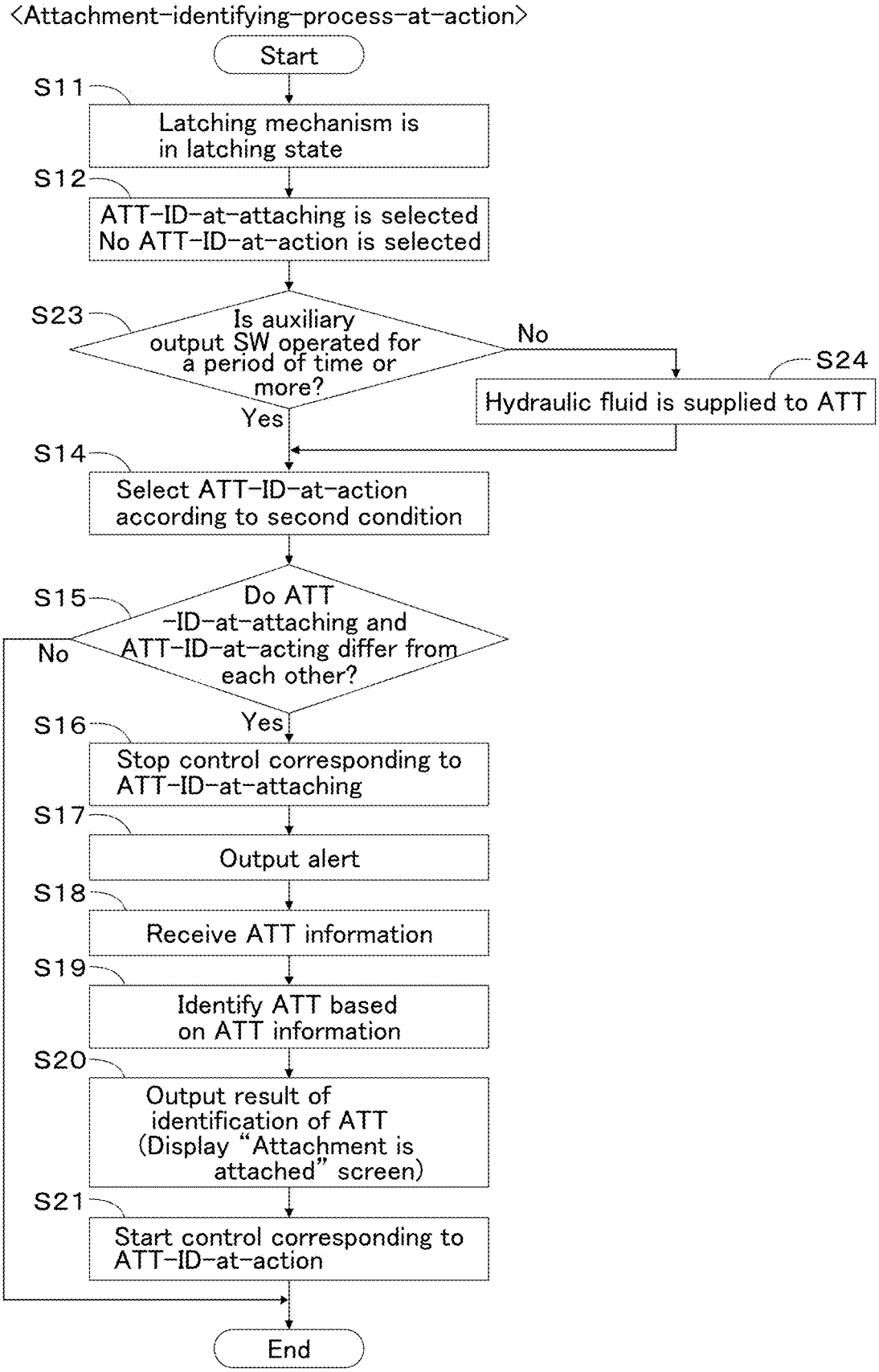
FIG. 15 is a flowchart showing a further example of an attachment-identifying-process-at-action.

In the example in FIG. 8, the controller 21 selects an attachment ID-at-action according to a second condition when at least one of the travel operator 6 or the work operator 7 is operated for a predetermined period of time or more (S13) (S14). However, for example, as shown in FIG. 14, the controller 21 may be configured or programmed to select an attachment ID-at-action according to a second condition after detecting that at least one of the traveling device 5 or the working device 4 is in action (S22) (S14). In such a case, the controller 21 may be configured or programmed to define the second condition such that the reference point in time for the advertisement signal Q1 receiving period is the point in time at which it is detected that at least one of the traveling device 5 or the working device 4 is in action. Alternatively, as shown in FIG. 15, the controller 21 may be configured or programmed to select an attachment ID-at-action according to a second condition when detecting that the auxiliary output switch 29 has been operated continuously for a predetermined period of time or more (YES in S23) (S14). The controller 21 may be configured or programmed to, when the sensor(s) 43 and/or 44 detect(s) that hydraulic fluid (power) is supplied via the hydraulic fluid outlet port 18*a* to the attachment 30 attached to the quick hitch 16 (S24), determine that the attachment 30 is in action and select an attachment ID-at-action according to a second condition, even if the auxiliary output switch 29 has not been operated continuously for a predetermined period of time or more (NO in S23) (S14).

In such cases, the controller 21 may define the second condition such that the reference point in time for the advertisement signal Q1 receiving period is the point in time at which the auxiliary output switch 29 is operated, the point in time at which it is detected that hydraulic fluid is supplied to the attachment 30, or the point in time at which it is determined that the attachment 30 is in action.

In the examples in FIGS. 8, 14, and 15, the controller 21 performs steps S13, S22, S23, and/or S24 after steps S11 and S12. Note, however, that the order in which the steps are performed may be selected appropriately or the steps may be performed concurrently.

The controller 21 performs the step of selecting an attachment ID-at-action (S14) after detecting that no attachment ID-at-action is selected (S12). Note, however, that, for example, the controller 21 may be configured or programmed to detect the number of times the step of selecting an attachment ID-at-action (S14) has been performed after the attachment ID-at-attaching is selected, instead of the above detecting step. Specifically, the controller 21 may be configured or programmed to limit the number of times step S14 is performed so that only one attachment ID-at-action is selected within the period from when an attachment ID-at-attaching is selected to when the detaching switch 27 is operated to allow the attachment 30 to be detached from the quick hitch 16.

Figure 16:
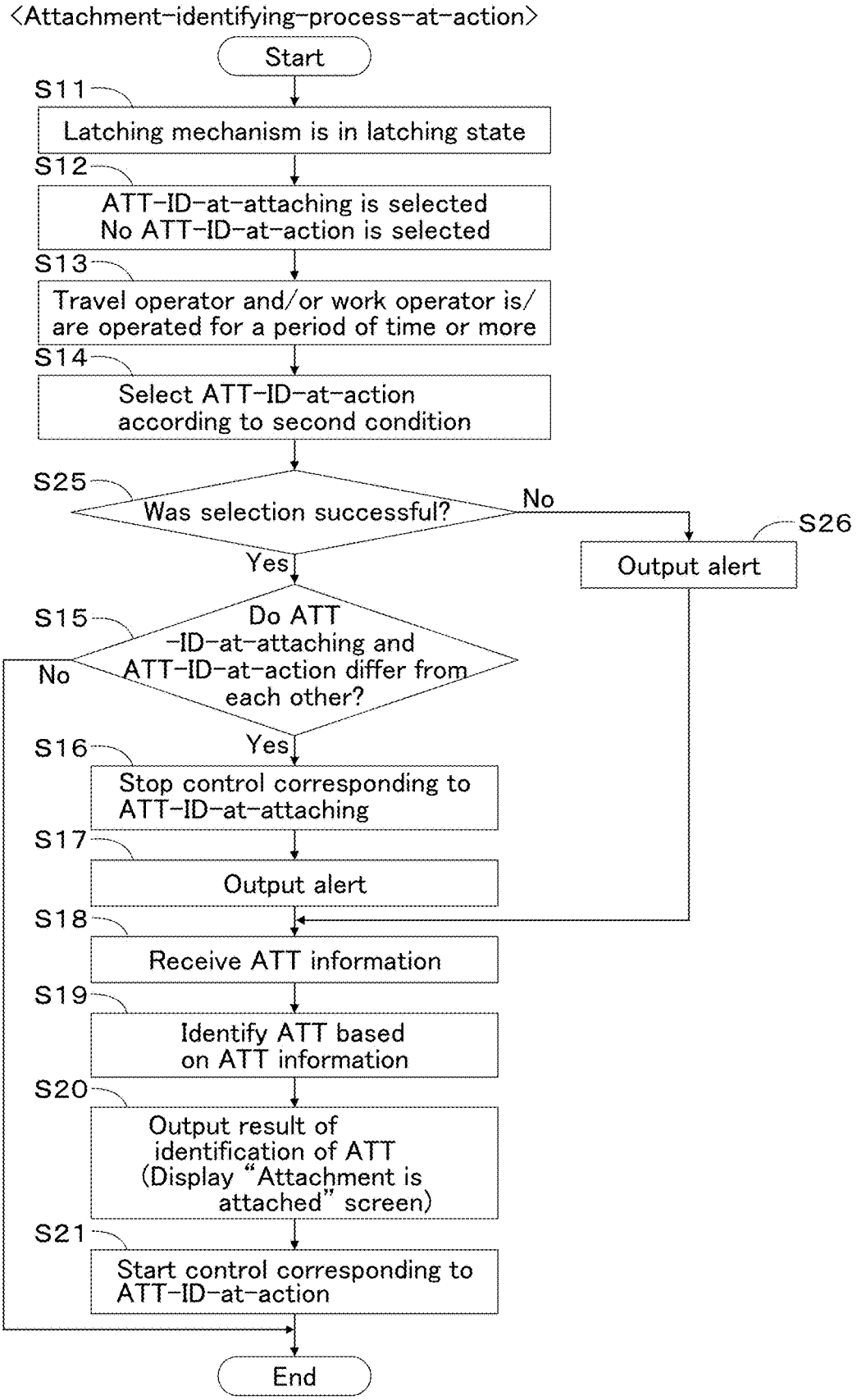
FIG. 16 is a flowchart showing still a further example of an attachment-identifying-process-at-action.

For example, as shown in FIG. 16, the controller 21 may be configured or programmed to cause an alert to be outputted (S26) when the controller 21 fails to select any attachment ID-at-action according to a second condition (NO in S25, not succeeded in selection). Specifically, in the example in FIG. 16, the controller 21 is configured or programmed to, if not succeeded in selecting an attachment ID-at-action according to a second condition after step S14 (NO in S25), cause the user interface 25 to display, on its screen, an alert window U4 including a prompt message asking for input of information indicating the attachment 30, as illustrated in, for example, FIG. 12 (in S26). In so doing, the controller 21 may cause the user interface 25 to display the attachment list L1 as shown in FIG. 13 together with the alert window U4.

When the user inputs the attachment information of the attachment 30 attached to the quick hitch 16 via the user interface 25 (S18), the controller 21 performs steps S19 to S21 as described earlier.

The controller 21 is configured or programmed to, if succeeded in selecting an attachment ID-at-action according to a second condition (YES in S25), compare the attachment ID-at-attaching and the attachment ID-at-action and perform steps S15 to S21 as described earlier. Steps S25 and S26 may be applied to the examples in FIGS. 14 and 15.

Figure 17:
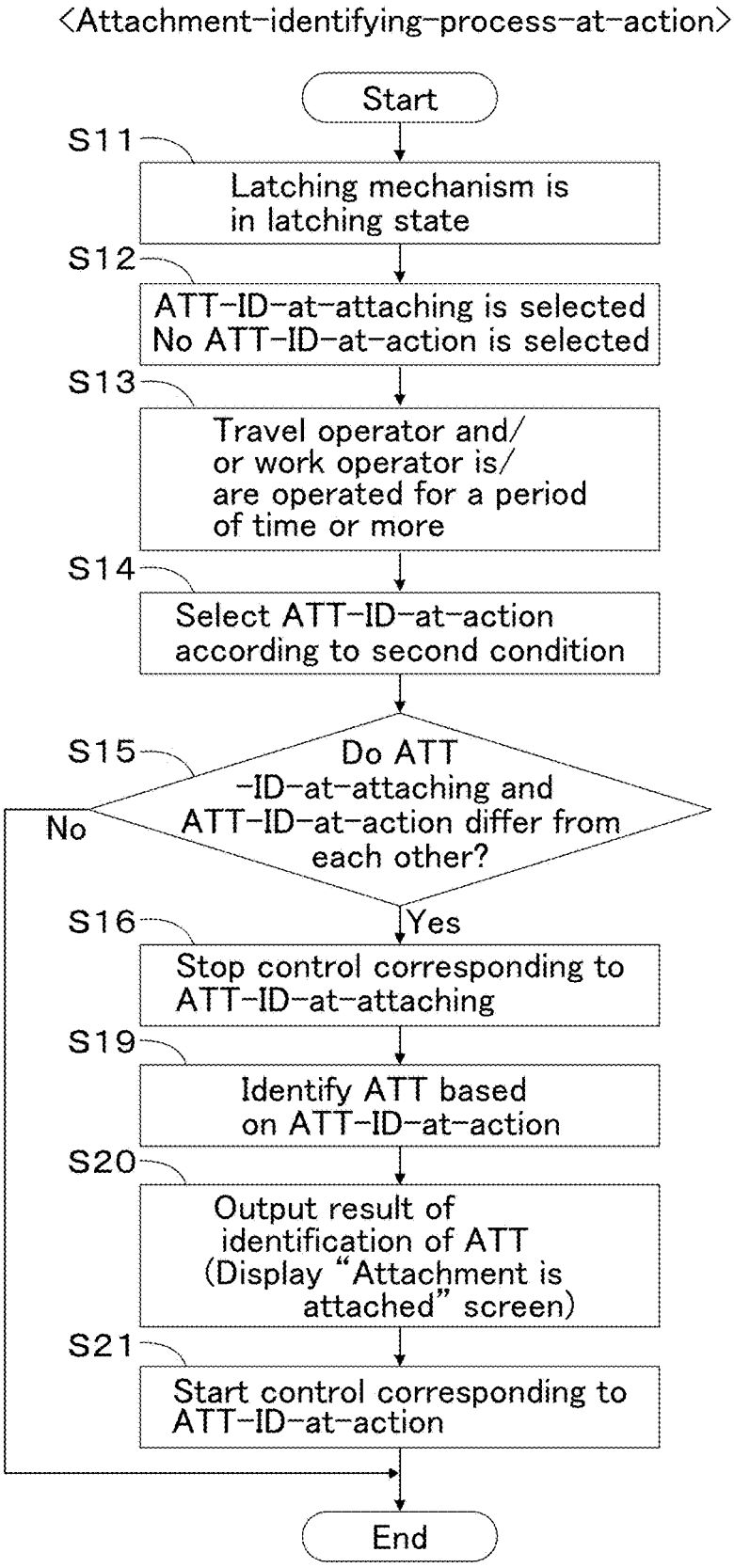
FIG. 17 is a flowchart showing still a further example of an attachment-identifying-process-at-action.

The controller 21 may be configured or programmed to, for example, as shown in FIG. 17, if the attachment ID-at-attaching and the attachment ID-at-action differ from each other (YES in S15), perform (start) a predetermined control (predetermined process) based on the attachment ID-at-action (S20, S21).

Specifically, in the example in FIG. 17, if the attachment ID-at-attaching and the attachment ID-at-action differ from each other (YES in S15), the controller 21 stops the predetermined control corresponding to the attachment ID-at-attaching (S16). Next, the controller 21 identifies the attachment 30 attached to the quick hitch 16 based on the attachment ID-at-action (S19), and causes the nonvolatile memory 22 to store the result of identification and causes the user interface 25 to display the result of identification (S20). The controller 21 starts a predetermined control based on the attachment ID-at-action (S21).

Note that, also in the example in FIG. 17, the controller 21 may be configured or programmed to perform step(s) S22, S23, and/or S24 instead of step S13 and perform step S14 as in FIGS. 14 and 15 as described earlier. In the example in FIG. 17, the controller 21 does not need to cause an alert to be outputted, or, for example, may cause the user interface 25 to output an alert after determining that the attachment ID-at-attaching and the attachment ID-at-action differ from each other (YES in S15) and before performing the predetermined process in steps S20 and S21. As shown in the example in FIG. 16, the controller 21 may cause an alert to be outputted (S26) when not succeeded in selecting an attachment ID-at-action (NO in S25).

The controller 21 may be configured or programmed such that the predetermined process performed based on at least one of the attachment ID-at-attaching or the attachment ID-at-action includes at least one of (i) outputting the result of identification of the attached attachment 30 (step S5 in FIG. 6, step S20 in FIG. 8, etc.) or (ii) performing control based on the attached attachment 30 (step S6 in FIG. 6, step S21 in FIG. 8, etc.) The controller 21 may be configured or programmed to not perform a predetermined process based on the attachment ID-at-attaching during the period from when the attachment ID-at-attaching is selected to when an attachment ID-at-action is selected, and, after determining whether the attachment ID-at-attaching and the attachment ID-at-action are the same as with each other or not, perform the predetermined process based on the result of determination and on at least one of the attachment ID-at-attaching or the attachment ID-at-action.

The controller 21 may be configured or programmed to cause the alert window U4 (FIG. 12), etc., to include, for example, icon(s) (symbol(s)) of the attachment(s) 30 attachable to the quick hitch 16 in a selectable manner instead of the attachment list L1 in FIG. 13. Alternatively, the controller 21 may cause the user interface 25 to display an input screen to receive input of attachment information such as an attachment ID.

In the example embodiments described above, the controller 21 causes the internal memory 21*a* to store, as ADV information, information included in advertisement signal(s) Q1 received by the beacon scanner 23, and/or the like. Note, however, that the controller 21 may be configured or programmed to cause the internal memory 21*a* to store, as ADV information, only information included in advertisement signal(s) Q1 which satisfy (satisfies) a predetermined storing condition among the received advertisement signal(s) Q1, together with RSSI and time information. The storing condition may be the same as or different from the first condition and/or the second condition.

In the example embodiments described above, the controller 21 causes the internal memory 21*a* to store ADV information and causes the nonvolatile memory 22 to store the attachment ID-at-attaching and the attachment ID-at-action. Note, however, that the ADV information, the attachment ID-at-attaching, and the attachment ID-at-action may be stored in a single memory and may be located inside or outside the controller 21.

In the above-described example embodiments, each attachment 30 is provided with a beacon transmitter 33 to transmit a wireless signal (advertisement signal Q1) compliant with Bluetooth (registered trademark) Low Energy, and the working vehicle 1 is provided with a beacon scanner 23 to receive the wireless signals. However, additionally or alternatively, for example, the attachment 30 may be provided with a transmitter such as a radio frequency identification (RFID) tag, and the working vehicle 1 may be provided with a receiver to receive wireless signals transmitted from the RFID. Additionally or alternatively, the attachment 30 may be provided with a transmitter to transmit radio waves for some other near field communication, and the working vehicle 1 may be provided with a receiver to receive the radio waves.

In the above-described example embodiments, the working vehicle 1 is provided with the quick hitch 16. Alternatively, the working vehicle 1 may be provided with a hitch having a different structure from the quick hitch 16, a quick hitch to which an attachment 30 can be attached and detached both automatically and manually, or a hitch to which an attachment 30 can be attached and detached only manually. In the case where the user manually attaches the attachment 30 to the hitch or manually detaches the attachment 30 from the hitch, the user may input information indicating that the attachment 30 is attached or detached using the user interface 25.

In the above-described example embodiments, the user inputs attachment information relating to the attachment 30 attached to the quick hitch 16 using the user interface 25 provided in or on the working vehicle 1 (step S18 in FIG. 8, etc.) However, for example, the user may input attachment information relating to the attachment 30 attached to the quick hitch 16 using a portable device 70. That is, the portable device 70 may be used as a user interface instead of the user interface 25.

In such a case, upon input of attachment information into the portable device 70, the portable device 70 transmits the attachment information to the communicator 24 of the working vehicle 1 via the Internet and/or the like. The controller 21 of the working vehicle 1 may, upon receipt of the attachment information by the communicator 24 (S18 in FIG. 8, etc.), perform steps S19 to S21 based on the attachment ID corresponding to the attachment information.

The controller 21 may be configured or programmed to use a portable device 70 external to the working vehicle 1 as an output, instead of the user interface 25 on the working vehicle 1. In such a case, the controller 21 may be configured or programmed to transmit, to the external output via the communicator 24, information indicating an alert (alert window U1 to U4) and/or information indicating the attachment list L1, etc., and cause the output to output such information. A controller such as an information processor external to the working vehicle 1 may perform processing similarly to the controller 21. That is, the controller and the output of the attachment usage system 100 may be provided somewhere other than the working vehicle 1.

In the above-described example embodiments, the working device 4, the quick hitch 16, and the specific attachment 30*b* are provided with hydraulic actuators (such as the boom cylinders 14, the front cylinders 15, and the latch cylinder 52). Additionally or alternatively, the working device 4, the quick hitch 16, and the specific attachment may be provided with other actuators such as electric actuators including electric motors or hydraulic actuators other than the hydraulic cylinders. In the case where an attachment including an electric actuator is attached to the quick hitch 16, the controller 21 may output, as power for the electric actuator, electricity (power) from the battery 20 (FIG. 1) to the attachment via an external electric wire based on control data corresponding to the attachment.

An attachment including a work member to be actuated by power from the prime mover 9 of the working vehicle 1 may be attached to the quick hitch 16. In the case where such an attachment including a work member is attached to the quick hitch 16, the controller 21 may output power from the prime mover 9 to the attachment via a power transmission mechanism including gear(s), shaft(s), and/or the like based on control data corresponding to the attachment.

A working vehicle 1 according to one or more example embodiments as has been discussed includes a hitch (quick hitch) 16 to attach and detach an attachment 30 thereto and therefrom, a receiver (beacon scanner) 23 to receive one or more wireless signals (advertisement signals) Q1 which are transmitted periodically from one or more transmitters (beacon transmitters) 33 in or on one or more of the attachments 30, which include respective one or more pieces of identification information (attachment IDs) of the one or more attachments 30, and which are compliant with a near field communication standard, and a controller 21.

An attachment usage system 100 as has been discussed is a system to use one or more attachments 30 on a working vehicle 1, and includes a hitch 16, one or more transmitters 33, a receiver 23, a controller 21, and an output 25.

The controller 21 is configured or programmed to, when the attachment 30 is attached to the hitch 16, select identification-information-at-attaching (attachment ID-at-attaching) as one of the one or more pieces of identification information that is included in one of the one or more wireless signals Q1 (e.g., one of the one or more wireless signals Q1, i) which is received by the receiver 23 and includes vibration information indicating that the attachment is vibrating and an RSSI highest among the one or more wireless signals, or ii) which is received most frequently among the one or more wireless signals in a first preset period of time), then, when the working vehicle 1 takes action, select identification-information-at-action (attachment ID-at-action) as one of the one or more pieces of identification information that is included in one of the one or more wireless signals Q1 (e.g., one of the one or more wireless signals Q1, i) which is received by the receiver 23 and includes vibration information indicating that the attachment is vibrating and an RSSI highest among the one or more wireless signals, or ii) which is received most frequently among the one or more wireless signals in a second preset period of time), and, if the identification-information-at-attaching and the identification-information-at-action differ from each other, cause an output 25 to output an alert and/or control start and stop of the supply of hydraulic fluid to the attachment and/or amount or pressure of hydraulic fluid supplied to the attachment based on the identification-information-at-action.

With the above configuration, even if the identification-information-at-attaching and/or the identification-information-at-action selected by the controller 21 as the identification information of the attached attachment 30 when the attachment 30 is attached to the working vehicle 1 and when the working vehicle 1 takes action afterward is/are wrong, since the output 25 outputs an alert, it is possible to deal with such an error. This allows a user such as the user of the working vehicle 1 to check the attachment 30 actually attached to the hitch 16 in response to the alert and perform an appropriate action such as inputting the identification information of the attachment 30 into the controller 21, making it possible to appropriately use attachments on the working vehicle 1.

Furthermore, since the controller 21 selects the identification information of the attachment 30 included in one of wireless signal(s) Q1 received by the receiver 23 when the attachment 30 is attached and when the working vehicle 1 takes action afterward, it is possible, compared to cases where the identification information of an attachment is identified upon each receipt of a wireless signal like existing techniques, to reduce the processing load on the controller 21 and smoothly perform a predetermined process corresponding to the attachment 30 attached to the working vehicle 1.

In one or more example embodiments, the working vehicle 1 may further include a user interface 25 which is the output 25. The controller 21 may be configured or programmed to cause the user interface 25 to output prompt information requesting to check the attachment 30 attached to the hitch 16, the prompt information being the alert.

This allows the user to check the attachment 30 actually attached to the hitch 16 in response to the alert and quickly perform an appropriate action such as inputting the identification information of the attachment 30 into the controller 21.

In one or more example embodiments, the controller 21 may be configured or programmed to perform a predetermined process based on the identification-information-at-attaching, and when attachment information is inputted via the user interface 25 after the alert is outputted, perform the predetermined process based on the attachment information.

With this, the user inputs the identification information indicating the attachment 30 actually attached to the hitch 16 via the user interface 25 in response to the alert, allowing the working vehicle to perform an appropriate predetermined process based on the attachment information.

In one or more example embodiments, the controller 21 is configured or programmed to, if the identification-information-at-attaching and the identification-information-at-action differ from each other, perform a predetermined process based on the identification-information-at-action.

With this, even if the identification-information-at-attaching selected by the controller 21 as the identification information of the attached attachment 30 when the attachment 30 is attached to the working vehicle 1 is wrong, it is possible to perform an appropriate predetermined process based on the more correct identification-information-at-action selected by the controller 21 as the identification information of the attached attachment 30 when the working vehicle 1 having the attachment 30 attached thereto takes action. This makes it possible to appropriately use attachments on the working vehicle.

In one or more example embodiments, the controller 21 may be configured or programmed to perform the predetermined process based on the identification-information-at-attaching and then select the identification-information-at-action.

With this, even if the identification-information-at-attaching is wrong, it is possible to appropriately determine whether to output an alert or perform a predetermined process based on the more correct identification-information-at-action selected when the working vehicle 1 having the attachment 30 attached thereto takes action.

In one or more example embodiments, the controller 21 may be configured or programmed to select one piece of identification-information-at-action during a period from when the controller 21 selects the identification-information-at-attaching to when the attachment 30 is allowed to be detached from the hitch 16.

With this, the controller 21 selects only one piece of identification-information-at-action included in one of wireless signal(s) Q1 that are received by the receiver 23 in the period from when the attachment 30 is attached to the hitch 16 to when the attachment 30 is allowed to be detached. This makes it possible to reduce the processing load on the controller 21 and smoothly perform a predetermined process corresponding to the attached attachment 30.

In one or more example embodiments, the working vehicle 1 may further include a vehicle body 2, and a traveling device 5 and a working device 4 which are on the vehicle body 2. The hitch 16 may be connected to the working device 4. The controller 21 may be configured or programmed to, when at least one of the traveling device 5 or the working device 4 takes action while the identification-information-at-attaching is selected but no identification-information-at-action is selected, select identification-information-at-action that is included in one of the one or more wireless signals Q1 received by the receiver 23 according to the predetermined condition.

With this, when the working vehicle 1 performs work for the first time using the attachment 30 attached to the hitch 16, even if the identification-information-at-attaching is wrong, it is possible to appropriately output an alert or perform a predetermined process based on the identification-information-at-action with high correctness. Furthermore, since the controller 21 selects a piece of identification information of the attachment 30 that is included in one of the wireless signals Q1 received by the receiver 23 only when the attachment 30 is attached and when at least one of the traveling device 5 or the working device 4 takes action while the identification-information-at-attaching is selected but no identification-information-at-action is selected, it is possible to reduce the processing load on the controller 21 and smoothly perform a predetermined process corresponding to the attached attachment 30.

In one or more example embodiments, the working vehicle 1 may further include a travel operator 6 to be operated to actuate the traveling device 5, and a work operator 7 to be operated to actuate the working device 4. In one or more example embodiments, the controller 21 may be configured or programmed to, when at least one of the travel operator 6 or the work operator 7 is operated while the identification-information-at-attaching is selected but no identification-information-at-action is selected, select identification-information-at-action that is included in one of the one or more wireless signals Q1 received by the receiver 23 according to the predetermined condition.

With this, when work is performed for the first time by causing at least one of the traveling device 5 or the working device 4 to take action with the attachment 30 attached, the controller 21 selects a piece of identification-information-at-action with high correctness as a piece of identification information of the attached attachment 30, making it possible to appropriately output an alert or perform a predetermined process based on the identification-information-at-action.

In one or more example embodiments, the controller 21 may be configured or programmed to cause a memory (internal memory) 21*a* to store the one or more pieces of identification information included in the one or more wireless signals Q1 after the receiver 23 receives the one or more wireless signals Q1, and, while the identification-information-at-attaching is selected but no identification-information-at-action is selected, select, according to the predetermined condition, identification-information-at-action that is included in one of one or more of the one or more wireless signals Q1 that are received by the receiver 23 during a period from a first point in time to a second point in time, the first point in time being a point in a first time period before when at least one of the travel operator 6 or the work operator 7 is operated, the second point in time being a point in a second time period after when the at least one of the travel operator 6 or the work operator 7 stops being operated.

With this, when work is performed for the first time by causing at least one of the traveling device 5 or the working device 4 to take action with the attachment 30 attached, it is possible for the controller 21 to select a piece of identification-information-at-action with higher correctness as a piece of identification information of the attached attachment 30 included in one of many wireless signals Q1 received by the receiver 23. It is also possible for the controller 21 to appropriately output an alert or perform a predetermined process based on the identification-information-at-action.

In one or more example embodiments, the working vehicle 1 may further include a power output port (hydraulic fluid outlet port) 18*a* to allow power to be outputted to the attachment 30 attached to the hitch 16, and a power operator (auxiliary output switch) 29 to be operated to allow power to be outputted through the power output port 18*a*. In one or more example embodiments, the controller 21 may be configured or programmed to, when the power operator 29 is operated and power is outputted through the power output port 18*a* while the identification-information-at-attaching is selected but no identification-information-at-action is selected, select, according to the predetermined condition, identification-information-at-action that is included in one of the one or more wireless signals Q1 received by the receiver 23.

With this, when work is performed for the first time by causing the attached attachment 30 to take action, it is possible to select a piece of identification-information-at-action with high correctness as a piece of identification information of the attached attachment 30.

In one or more example embodiments, the controller 21 may be configured or programmed to, when the attachment 30 is attached to the hitch 16, select identification-information-at-attaching that is included in one of the one or more wireless signals Q1 received by the receiver 23 according to a first condition, and when the working vehicle 1 takes action while the identification-information-at-attaching is selected but no identification-information-at-action is selected, select identification-information-at-action that is included in one of the one or more wireless signals Q1 received by the receiver 23 according to a second condition differing from the first condition.

With this, it is possible to select identification-information-at-action with higher correctness as a piece of identification information of the attached attachment 30 using the second condition which differs from the first condition for selection of identification-information-at-attaching.

In one or more example embodiments, the second condition may include a condition in which the controller 21 selects, as the identification-information-at-action, a piece of identification information included in a specific wireless signal Q1 which is one of one or more of the one or more wireless signals Q1 that are higher in terms of a received signal strength (RSSI) than a predetermined value and that include vibration information indicating that the attachment 30 is vibrating.

With this, it is possible to select identification-information-at-action with higher correctness as a piece of identification information of the attached attachment 30 when the working vehicle 1 takes action.

In one or more example embodiments, the second condition may include a condition in which the controller 21 selects, as the identification-information-at-action, a piece of identification information included in a specific wireless signal Q1 which is one of two or more of the one or more wireless signals Q1 that are the same in terms of a piece of identification information included therein and that have been received a predetermined number of times or more within a predetermined period of time.

With this, it is possible to select identification-information-at-action with higher correctness as a piece of identification information of the attached attachment 30 when the working vehicle 1 takes action.

In one or more example embodiments, the first condition may include a condition which the controller 21 selects, as the identification-information-at-attaching, a piece of identification information included in a specific wireless signal Q1, which is the highest in terms of received signal strength, of the wireless signals Q1 that are higher in terms of a received signal strength than a predetermined value and include vibration information indicating that the attachment 30 is vibrating.

With this, it is possible to improve the correctness of the identification-information-at-attaching as the piece of identification information of the attached attachment 30.

In one or more example embodiments, the working vehicle 1 may further include an attaching switch 26 to be operated to attach the attachment 30 to the hitch 16. In one or more example embodiments, the controller 21 may be configured or programmed to select, according to the predetermined condition, identification-information-at-attaching that is included in one of the one or more wireless signals Q1 received by the receiver 23 when the attaching switch 26 is operated or when the attaching switch 26 has been operated continuously for a predetermined period of time or more.

With this, it is possible, when the attachment 30 is attached via the hitch 16 to the working vehicle 1, to select the piece of identification information of the attachment 30 as the identification-information-at-attaching.

In one or more example embodiments, the controller 21 may be configured or programmed to select, according to the predetermined condition, identification-information-at-attaching that is included in one of the one or more wireless signals Q1 received by the receiver 23 in at least one of (i) a third time period which ends when the attaching switch 26 is operated or when the attaching switch 26 has been operated continuously for the predetermined period of time or more or (ii) a fourth time period which starts when the attaching switch 26 is operated or when the attaching switch 26 has been operated continuously for the predetermined period of time or more.

With this, it is possible to select, as a piece of identification information of the attached attachment 30 with higher correctness, identification-information-at-attaching included in one of many wireless signals Q1 that are received by the receiver 23 around when the attachment 30 is attached to the hitch 16.

In one or more example embodiments, the controller 21 may be configured or programmed to, if the controller 21 fails to select any identification-information-at-action according to the predetermined condition, cause the output 25 to output an alert.

With this, even if no identification-information-at-action is selected, it is possible for the user to check whether or not the attachment 30 corresponding to the identification-information-at-attaching is the attachment 30 actually attached to the hitch 16.

In one or more example embodiments, the output 25 may include a display (user interface) 25. Each of the one or more transmitters 33 is a beacon transmitter to transmit an advertisement signal Q1 including a piece of identification information of the attachment 30 in or on which the transmitter 33 is provided. The receiver 23 may be a beacon scanner to receive the advertisement signal Q1.

With this, it is possible to cause the display 25 to display information such as an alert to allow the user to easily recognize the information. Furthermore, the one-way communication from highly versatile beacon transmitters 33 to the beacon scanner 23 makes it possible to easily select the identification information of the attachment 30 attached to the hitch 16 of the working vehicle 1 and to quickly start a predetermined process based on the identification information.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working vehicle comprising:

a hitch to attach and detach an attachment thereto and therefrom;

a receiver to receive one or more wireless signals which are transmitted periodically from one or more transmitters in or on one or more of the attachments, which include respective one or more pieces of identification information of the one or more attachments or identification information of the one or more transmitters, and which are compliant with a near field communication standard; and a controller; wherein the controller is configured or programmed to:

when the attachment is attached to the hitch, select, as identification-information-at-attaching, one of the one or more pieces of identification information that is included in one of the one or more wireless signals that either is received by the receiver and includes vibration information indicating that the attachment is vibrating and an RSSI highest among the one or more wireless signals according to a condition (i), or is received by the receiver most frequently among the one or more wireless signals in a first preset period of time according to a condition (ii); then when the working vehicle takes action, select, as identification-information-at-action, one of the one or more pieces of identification information that is included in one of the one or more wireless signals that either is received by the receiver and includes vibration information indicating that the attachment is vibrating and an RSSI (Received Signal Strength Indicator) highest among the one or more wireless signals according to the condition (i), or is received by the receiver most frequently among the one or more wireless signals in a second preset period of time according to the condition (ii); and if the identification-information-at-attaching and the identification-information-at-action differ from each other, cause an output to output an alert, and control start and stop of the supply of hydraulic fluid to the attachment and/or amount or pressure of hydraulic fluid supplied to the attachment based on the identification-information-at-action; and when the one or more wireless signals received to select the identification-information-at-attaching is received according to the condition (i), then the one or more wireless signals received to select the identification-information-at-action is received according to the condition (i), and when the one or more wireless signals received to select the identification-information-at-attaching is received according to the condition (ii), then the one or more wireless signals received to select the identification-information-at-action is received according to the condition (ii).

2. The working vehicle according to claim 1, further comprising a user interface which is the output; wherein the controller is configured or programmed to cause the user interface to output prompt information requesting to check the attachment attached to the hitch, the prompt information being the alert.

3. The working vehicle according to claim 1, wherein the controller is configured or programmed to select one piece of identification-information-at-action during a period from when the controller selects the identification-information-at-attaching to when the attachment is allowed to be detached from the hitch.

4. The working vehicle according to claim 1, further comprising:

a vehicle body; and a traveling device including a hydro-static transmission and a working device including a boom cylinder and a front cylinder containing a hydraulic or electric actuator for actuating the attachment, which are on the vehicle body; wherein the hitch is connected to the working device; and the controller is configured or programmed to, when at least one of the traveling device or the working device takes action while the identification-information-at-attaching is selected but no identification-information-at-action is selected, select the identification-information-at-action.

5. The working vehicle according to claim 4, further comprising:

a travel operator to be operated to actuate the traveling device; and a work operator to be operated to actuate the working device; wherein the controller is configured or programmed to, when at least one of the travel operator or the work operator is operated while the identification-information-at-attaching is selected but no identification-information-at-action is selected, select the identification-information-at-action.

6. The working vehicle according to claim 4, further comprising:

a travel operator to be operated to actuate the traveling device; and a work operator to be operated to actuate the working device; wherein the controller is configured or programmed to:

cause a memory to store the one or more pieces of identification information included in the one or more wireless signals after the receiver receives the one or more wireless signals; and while the identification-information-at-attaching is selected but no identification-information-at-action is selected, select the identification-information-at-action that is included in one of one or more of the one or more wireless signals that are received by the receiver during a period from a first point in time to a second point in time, the first point in time being a point in a first time period before when at least one of the travel operator or the work operator is operated, the second point in time being a point in a second time period after when the at least one of the travel operator or the work operator stops being operated.

7. The working vehicle according to claim 1, further comprising:

a power output port to allow power to be outputted to the attachment attached to the hitch; and a power operator to be operated to allow power to be outputted through the power output port; wherein the controller is configured or programmed to, when the power operator is operated and power is outputted through the power output port while the identification-information-at-attaching is selected but no identification-information-at-action is selected, select the identification-information-at-action that is included in one of the one or more wireless signals received by the receiver.

8. The working vehicle according to claim 1, further comprising an attaching switch to be operated to attach the attachment to the hitch; wherein the controller is configured or programmed to select the identification-information-at-attaching that is included in one of the one or more wireless signals received by the receiver when the attaching switch is operated or when the attaching switch has been operated continuously for a predetermined period of time or more.

9. The working vehicle according to claim 8, wherein the controller is configured or programmed to select the identification-information-at-attaching that is included in one of the one or more wireless signals received by the receiver in at least one of (i) a third time period which ends when the attaching switch is operated or when the attaching switch has been operated continuously for the predetermined period of time or more or (ii) a fourth time period which starts when the attaching switch is operated or when the attaching switch has been operated continuously for the predetermined period of time or more.

10. The working vehicle according to claim 1, wherein the controller is configured or programmed to, if the controller fails to select the identification-information-at-action, cause the output to output an alert.

11. The working vehicle according to claim 1, wherein the output includes a display;

each of the one or more transmitters is a beacon transmitter to transmit an advertisement signal including a piece of identification information of the attachment in or on which the transmitter is provided; and the receiver is a beacon scanner to receive the advertisement signal.

12. A working vehicle comprising:

a hitch to attach and detach an attachment thereto and therefrom;

a receiver to receive one or more wireless signals which are transmitted periodically from one or more transmitters in or on one or more of the attachments or identification information of the one or more transmitters, which include respective one or more pieces of identification information of the one or more attachments, and which are compliant with a near field communication standard; and a controller; wherein the controller is configured or programmed to:

when the attachment is attached to the hitch, select, as identification-information-at-attaching, one of the one or more pieces of identification information that is included in one of the one or more wireless signals that either is received by the receiver and includes vibration information indicating that the attachment is vibrating and an RSSI (Received Signal Strength Indicator) highest among the one or more wireless signals according to a condition (i), or is received by the receiver most frequently among the one or more wireless signals in a first preset period of time according to a condition (ii); then when the working vehicle takes action, select, as identification-information-at-action, one of the one or more pieces of identification information that is included in one of the one or more wireless signals that either is received by the receiver and includes vibration information indicating that the attachment is vibrating and an RSSI (Received Signal Strength Indicator) highest among the one or more wireless signals according to the condition (i), or is received by the receiver most frequently among the one or more wireless signals in a second preset period of time according to the condition (ii); and if the identification-information-at-attaching and the identification-information-at-action differ from each other, control start and stop of the supply of hydraulic fluid to the attachment and/or amount or pressure of hydraulic fluid supplied to the attachment based on the identification-information-at-action; and when the one or more wireless signals received to select the identification-information-at-attaching is received according to the condition (i), then the one or more wireless signals received to select the identification-information-at-action is received according to the condition (i), and when the one or more wireless signals received to select the identification-information-at-attaching is received according to the condition (ii), then the one or more wireless signals received to select the identification-information-at-action is received according to the condition (ii).

13. The working vehicle according to claim 12, wherein the controller is configured or programmed to select one piece of identification-information-at-action during a period from when the controller selects the identification-information-at-attaching to when the attachment is allowed to be detached from the hitch.

14. The working vehicle according to claim 12, further comprising:

a vehicle body; and a traveling device including a hydro-static transmission and a working device including a boom cylinder and a front cylinder containing a hydraulic or electric actuator for actuating the attachment, which are on the vehicle body; wherein the hitch is connected to the working device; and the controller is configured or programmed to, when at least one of the traveling device or the working device takes action while the identification-information-at-attaching is selected but no identification-information-at-action is selected, select the identification-information-at-action that is included in one of the one or more wireless signals received by the receiver.

15. The working vehicle according to claim 14, further comprising:

a travel operator to be operated to actuate the traveling device; and a work operator to be operated to actuate the working device; wherein the controller is configured or programmed to, when at least one of the travel operator or the work operator is operated while the identification-information-at-attaching is selected but no identification-information-at-action is selected, select the identification-information-at-action that is included in one of the one or more wireless signals received by the receiver.

16. The working vehicle according to claim 14, further comprising:

a travel operator to be operated to actuate the traveling device; and a work operator to be operated to actuate the working device; wherein the controller is configured or programmed to:

cause a memory to store the one or more pieces of identification information included in the one or more wireless signals after the receiver receives the one or more wireless signals; and while the identification-information-at-attaching is selected but no identification-information-at-action is selected, select the identification-information-at-action that is included in one of one or more of the one or more wireless signals that are received by the receiver during a period from a first point in time to a second point in time, the first point in time being a point in a first time period before when at least one of the travel operator or the work operator is operated, the second point in time being a point in a second time period after when the at least one of the travel operator or the work operator stops being operated.

17. The working vehicle according to claim 12, further comprising:

a power output port to allow power to be outputted to the attachment attached to the hitch; and a power operator to be operated to allow power to be outputted through the power output port; wherein the controller is configured or programmed to, when the power operator is operated and power is outputted through the power output port while the identification-information-at-attaching is selected but no identification-information-at-action is selected, select the identification-information-at-action that is included in one of the one or more wireless signals received by the receiver.

18. The working vehicle according to claim 12, further comprising an attaching switch to be operated to attach the attachment to the hitch; wherein the controller is configured or programmed to select the identification-information-at-attaching that is included in one of the one or more wireless signals received by the receiver when the attaching switch is operated or when the attaching switch has been operated continuously for a predetermined period of time or more.

19. The working vehicle according to claim 18, wherein the controller is configured or programmed to select the identification-information-at-attaching that is included in one of the one or more wireless signals received by the receiver in at least one of (i) a third time period which ends when the attaching switch is operated or when the attaching switch has been operated continuously for the predetermined period of time or more or (ii) a fourth time period which starts when the attaching switch is operated or when the attaching switch has been operated continuously for the predetermined period of time or more.

20. The working vehicle according to claim 12, wherein each of the one or more transmitters is a beacon transmitter to transmit an advertisement signal including a piece of identification information of the attachment in or on which the transmitter is provided; and the receiver is a beacon scanner to receive the advertisement signal.

21. An attachment usage system to use one or more attachments on a working vehicle, the attachment usage system comprising:

a hitch on the working vehicle to attach and detach an attachment thereto and therefrom;

one or more transmitters in or on one or more of the attachments to periodically transmit one or more wireless signals which include respective one or more pieces of identification information of the one or more attachments or identification information of the one or more transmitters, and which are compliant with a near field communication standard;

a receiver in or on the working vehicle to receive the one or more wireless signals transmitted from the one or more transmitters;

a controller; and an output; wherein the controller is configured or programmed to:

when the attachment is attached to the hitch, select, as identification-information-at-attaching, one of the one or more pieces of identification information that is included in one of the one or more wireless signals that either is received by the receiver and includes vibration information indicating that the attachment is vibrating and an RSSI (Received Signal Strength Indicator) highest among the one or more wireless signals according to a condition (i), or is received by the receiver most frequently among the one or more wireless signals in a first preset period of time according to a condition (ii); then when the working vehicle takes action, select, as identification-information-at-action, one of the one or more pieces of identification information that is included in one of the one or more wireless signals that either is received by the receiver and includes vibration information indicating that the attachment is vibrating and an RSSI (Received Signal Strength Indicator) highest among the one or more wireless signals according to the condition (i), or is received by the receiver most frequently among the one or more wireless signals in a second preset period of time according to the condition (ii); and if the identification-information-at-attaching and the identification-information-at-action differ from each other, cause the output to output an alert, and control start and stop of the supply of hydraulic fluid to the attachment and/or amount or pressure of hydraulic fluid supplied to the attachment based on the identification-information-at-action; and when the one or more wireless signals received to select the identification-information-at-attaching is received according to the condition (i), then the one or more wireless signals received to select the identification-information-at-action is received according to the condition (i), and when the one or more wireless signals received to select the identification-information-at-attaching is received according to the condition (ii), then the one or more wireless signals received to select the identification-information-at-action is received according to the condition (ii).

22. An attachment usage system to use one or more attachments on a working vehicle, the attachment usage system comprising:

a hitch on the working vehicle to attach and detach an attachment thereto and therefrom;

one or more transmitters in or on one or more of the attachments to periodically transmit one or more wireless signals which include respective one or more pieces of identification information of the one or more attachments or identification information of the one or more transmitters, and which are compliant with a near field communication standard;

a receiver in or on the working vehicle to receive the one or more wireless signals transmitted from the one or more transmitters;

a controller; and an output; wherein the controller is configured or programmed to:

when the attachment is attached to the hitch, select, as identification-information-at-attaching, one of the one or more pieces of identification information that is included in one of the one or more wireless signals that either is received by the receiver and includes vibration information indicating that the attachment is vibrating and an RSSI (Received Signal Strength Indicator) highest among the one or more wireless signals according to a condition (i), or is received by the receiver most frequently among the one or more wireless signals in a first preset period of time according to a condition (ii); then when the working vehicle takes action, select, as identification-information-at-action, one of the one or more pieces of identification information that is included in one of the one or more wireless signals that either is received by the receiver and includes vibration information indicating that the attachment is vibrating and an RSSI (Received Signal Strength Indicator) highest among the one or more wireless signals according to the condition (i), or is received by the receiver most frequently among the one or more wireless signals in a second preset period of time according to the condition (ii); and if the identification-information-at-attaching and the identification-information-at-action differ from each other, control start and stop of the supply of hydraulic fluid to the attachment and/or amount or pressure of hydraulic fluid supplied to the attachment based on the identification-information-at-action; and when the one or more wireless signals received to select the identification-information-at-attaching is received according to the condition (i), then the one or more wireless signals received to select the identification-information-at-action is received according to the condition (i), and when the one or more wireless signals received to select the identification-information-at-attaching is received according to the condition (ii), then the one or more wireless signals received to select the identification-information-at-action is received according to the condition (ii).

* * * * *